US006913315B2

(12) United States Patent
Ball et al.

(10) Patent No.: US 6,913,315 B2
(45) **Date of Patent: *Jul. 5, 2005**

(54) CHAIR CONSTRUCTION

(75) Inventors: Douglas C. Ball, Senneville (CA); Leon Goldick, Beaconsville (CA); Alain Deslauriers, Ile Laval (CA); Jeff G. Sokalski, Montreal (CA)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/659,662

(22) Filed: Sep. 10, 2003

(65) Prior Publication Data

US 2004/0046432 A1 Mar. 11, 2004

Related U.S. Application Data

(63) Continuation of application No. 10/270,228, filed on Oct. 10, 2002, now Pat. No. 6,698,833, which is a continuation of application No. 09/579,166, filed on May 25, 2000, now Pat. No. 6,523,898

(60) Provisional application No. 60/139,599, filed on Jun. 17, 1999.

(51) Int. Cl.[7] ..... A47C 3/025

(52) U.S. Cl. ..... 297/284.7; 297/284.4

(58) Field of Search ..... 297/284.4, 284.7

(56) References Cited

U.S. PATENT DOCUMENTS

| | | | |
|---|---|---|---|
| 2,549,902 | A | 4/1951 | Hibbard et al. |
| 4,576,351 | A | 3/1986 | Brink |
| 4,695,096 | A | 9/1987 | Kincaid |
| 4,961,610 | A | 10/1990 | Reeder et al. |
| 5,143,422 | A | 9/1992 | Althofer et al. |
| 5,368,365 | A | 11/1994 | Feldberg |
| 5,393,124 | A | 2/1995 | Neil |
| 5,415,459 | A | 5/1995 | Schultz |
| 5,484,187 | A | 1/1996 | Doerner et al. |
| 5,487,591 | A | 1/1996 | Knoblock |
| 5,590,934 | A | 1/1997 | Gibbs |
| 5,599,067 | A | 2/1997 | Schuelke et al. |
| 5,630,647 | A | 5/1997 | Heidmann et al. |
| 5,641,203 | A | 6/1997 | Van De Riet et al. |
| 5,647,638 | A | 7/1997 | Ritt et al. |
| 5,651,586 | A | 7/1997 | Groth |
| 5,655,814 | A | 8/1997 | Gibbs |
| 5,749,628 | A | 5/1998 | Synder et al. |
| 5,795,026 | A | 8/1998 | Dral et al. |
| 5,848,823 | A | 12/1998 | Su |
| 5,853,223 | A | 12/1998 | Ritt et al. |
| 5,876,097 | A | 3/1999 | Cao |
| 5,895,095 | A | 4/1999 | Chen |

(Continued)

FOREIGN PATENT DOCUMENTS

| | | |
|---|---|---|
| CA | 1315186 | 3/1993 |
| WO | WO9325121 | 12/1993 |

*Primary Examiner*—Anthony D. Barfield
(74) *Attorney, Agent, or Firm*—Price, Heneveld, Cooper, DeWitt & Litton

(57) ABSTRACT

A chair includes a base having a control assembly operably supporting a seat assembly and also a back assembly for movement about a seat tilt axis and a back tilt axis, respectively. The back assembly includes a flexible sheet supported at upper/outer corners by a back support structure and hanging downwardly. The flexible sheet includes a lower portion coupled to the back support structure by a tensioner for holding the lower portion rearwardly. A vertically-adjustable lumbar mechanism is adjustably supported on the back support structure and operably engages the flexible sheet for flexing a lumbar area of the flexible sheet forwardly to provide an optimal ergonomic horizontal and vertical convex shape for postural lumbar support.

53 Claims, 24 Drawing Sheets

U.S. PATENT DOCUMENTS 5,909,923 A 6/1999 DeKraker
5,927,811 A 7/1999 Tseng
5,944,386 A 8/1999 Yamagishi et al.
6,017,091 A 1/2000 Cao
6,053,578 A 4/2000 Van Hekken et al.
6,053,579 A 4/2000 Nelson et al.
6,059,362 A 5/2000 Lin
6,109,694 A 8/2000 Kurtz
6,125,521 A 10/2000 Stumpf et al.
6,419,318 B1 7/2002 Albright
6,471,294 B1 * 10/2002 Dammermann et al. ..... 297/284.7 X
6,568,760 B2 5/2003 Davis et al.
6,572,190 B2 6/2003 Koepke et al.
6,598,251 B2 7/2003 Habboub et al.

* cited by examiner

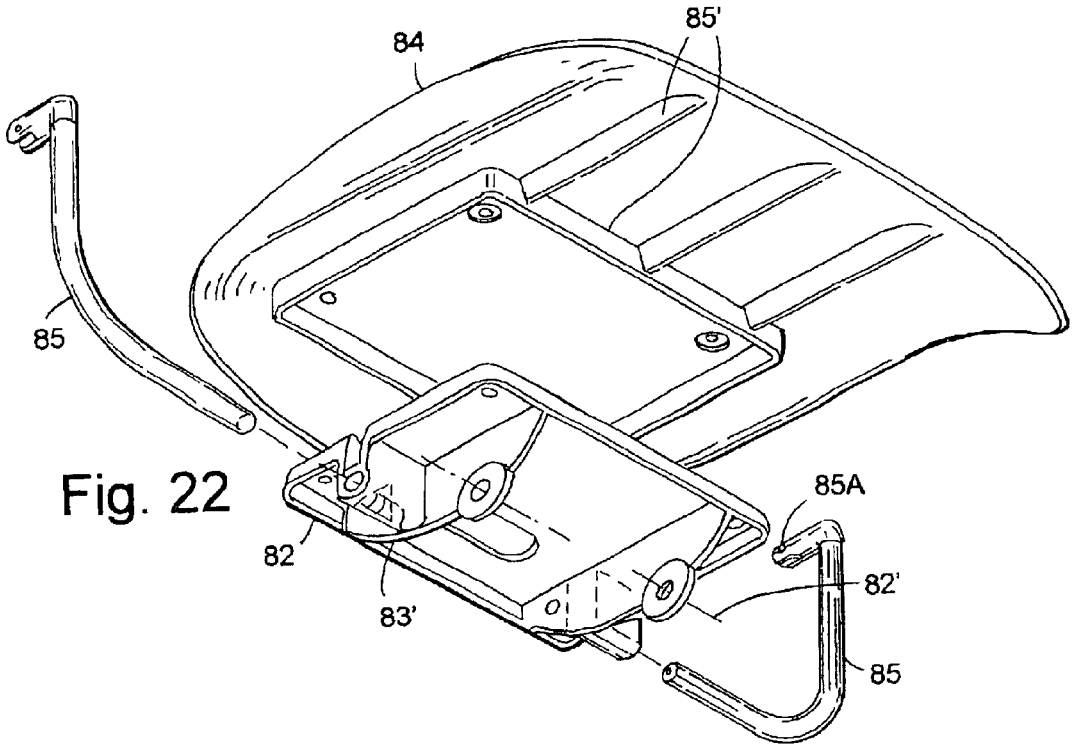
Fig. 22
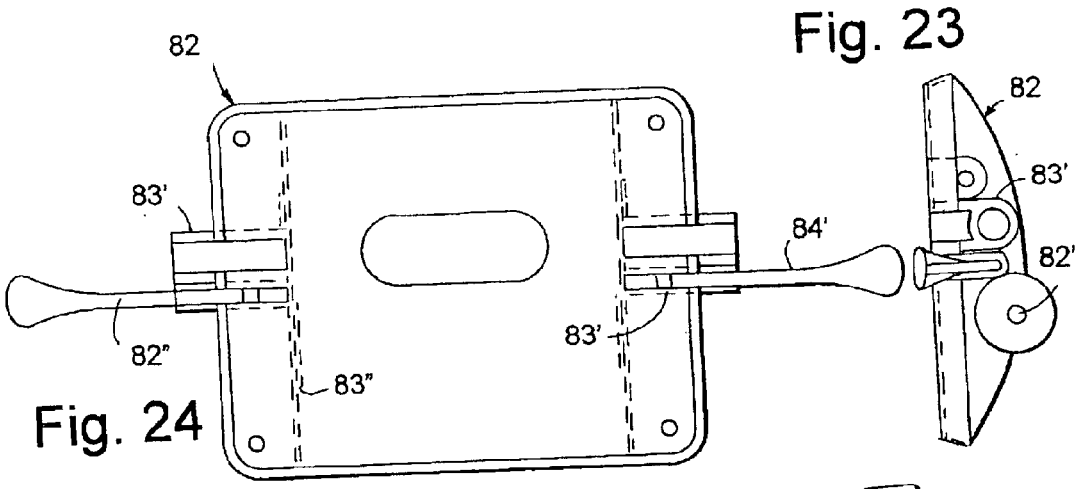
Fig. 23
Fig. 24
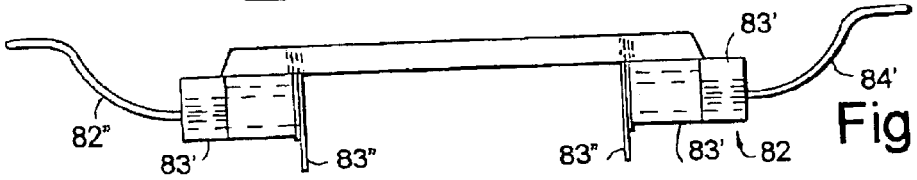
Fig. 25

58
122
115
120
120
119
118
114
114
112
115
122
111
111
113
60
113
58
114

115
58
114
114
58
113
113
111
117
103
111
60
60

CHAIR CONSTRUCTION

RELATED APPLICATIONS

This application is a continuation of commonly assigned, co-invented application Ser. No. 10/270,228, filed Oct. 10, 2002, entitled CHAIR CONSTRUCTION, now U.S. Pat. No. 6,698,833, which is a continuation of commonly assigned, co-invented application Ser. No. 09/579,166, filed May 25, 2000, entitled CHAIR CONSTRUCTION, now U.S. Pat. No. 6,523,898, which claims priority to provisional application Ser. No. 60/139,599, filed Jun. 17, 1999, entitled ADJUSTABLE CHAIR CONSTRUCTION.

BACKGROUND OF THE INVENTION

The present invention relates to an adjustable chair construction having an adjustable back and seat configured to provide optimal postural support to a seated user during recline. More particularly, the back includes a flexible back shell and a lumbar mechanism for adjusting a shape of the flexible back shell for improved lumbar support. The chair further includes a seat and a reclineable back that move with a synchronous motion during recline of the back.

There are many adjustable chairs in the art, including chairs having adjustable backs. However, adjustability continues to be a concern since users have so many different body shapes and preferences. Further, improvements are desired in the adjustment mechanisms, so that they are simpler and more intuitive to operate. In particular, lumbar support and adjustability continue to be very important to seated users. This is due in part to the fact that people are spending considerable time in chairs, and also the health of users' backs, and back pain can be affected. Thus, good lumbar support and health continues to be of concern. It is noted that the lumbar area on chairs is highly visible and easily reachable, which further results in functional and aesthetic attention being directed to the lumbar area and adjustment mechanisms for the same.

In regard to synchronized seat and back movements, synchronous chairs, such as Steelcase's Sensor chair, have gained wide market acceptance for providing postural support during back recline while also providing simultaneous seat and back rotation that minimizes sheer or "shirt pull" in the lumbar area of a seated user. However, further improvement is desired so that these mechanisms provide even greater adjustability in terms of the particular synchrotilt motion that they provide. For example, a non-uniform synchronous motion is often desired, where the back and seat move at a changing ratio during recline. From a manufacturing standpoint, it is preferable that these new movements and back tilt axis locations still use as many existing parts as possible, and that they be as simple as possible. Also, many consumers are looking for a new modernistic appearance.

Accordingly, a chair including an improved back construction, armrest construction, and overall construction is desired solving the aforementioned problems, but that provides the adjustability, low cost, and ease of assembly needed in the competitive chair industry.

SUMMARY OF THE INVENTION

In one aspect of the present invention, a chair includes a base, a chair control mounted on the base, and a seat supported on the chair control. A back upright is pivotally attached to the chair control for movement between upright and reclined positions. A flexible polymeric sheet is attached at upper and lower connections to the back upright. A vertically adjustable lumbar mechanism is attached to the back upright and configured to bend the flexible sheet forwardly between the upper and lower connections to support a seated user's lumbar region.

In another aspect of the present invention, a seating unit includes a base. A back upright is pivotally supported on the base for movement between an upright position and a reclined position. A flexible sheet is operably supported on the back upright and adapted to ergonomically support a seated user. A vertically adjustable lumbar mechanism is operably movably attached to the back upright and configured to bend the flexible sheet and change a shape of the flexible sheet forwardly to ergonomically adjustably support a lumbar region of the seated user.

In another aspect of the present invention, a chair includes a base, a chair control mounted on the base, and a seat supported on the chair control. A back upright is pivotally attached to the chair control for movement between upright and reclined positions. A flexible polymeric sheet is attached at upper and lower connections to the back upright, the lower connection being near a bottom of the sheet. The sheet includes perforations, at least some of which are slots, allowing airflow and including a support surface adapted to ergonomically engage and support a seated user. A vertically adjustable lumbar mechanism is attached to the back upright and configured to bend the flexible sheet forwardly between the upper and lower connections to support a seated user's lumbar region.

In still another aspect of the present invention, a chair includes a base, a chair control mounted on the base, and a seat supported on the chair control. A back upright is pivotally attached to the chair control for movement between upright and reclined positions. The seat is operably supported to move synchronously during recline of the back upright. A flexible polymeric sheet is attached at upper and lower connections to the back upright, the lower connection being near a bottom of the sheet; the sheet including perforations allowing airflow and including a support surface adapted to ergonomically engage and support a seated user. An adjustable lumbar mechanism is attached to the back upright and configured to bend the flexible sheet forwardly between the upper and lower connections to support a seated user's lumbar region.

These and other inventive aspects, objects, and advantages will become apparent to one of ordinary skill in the art upon review of the attached specification, claims, and appended drawings.

DESCRIPTION OF DRAWINGS

FIG. 22 is an exploded bottom perspective view of the seat support;

FIGS. 23–25 are side, top, and front views of the seat support bottom bracket shown in FIG. 22;

DETAILED DESCRIPTION OF PREFERRED EMBODIMENT

Figure 5:
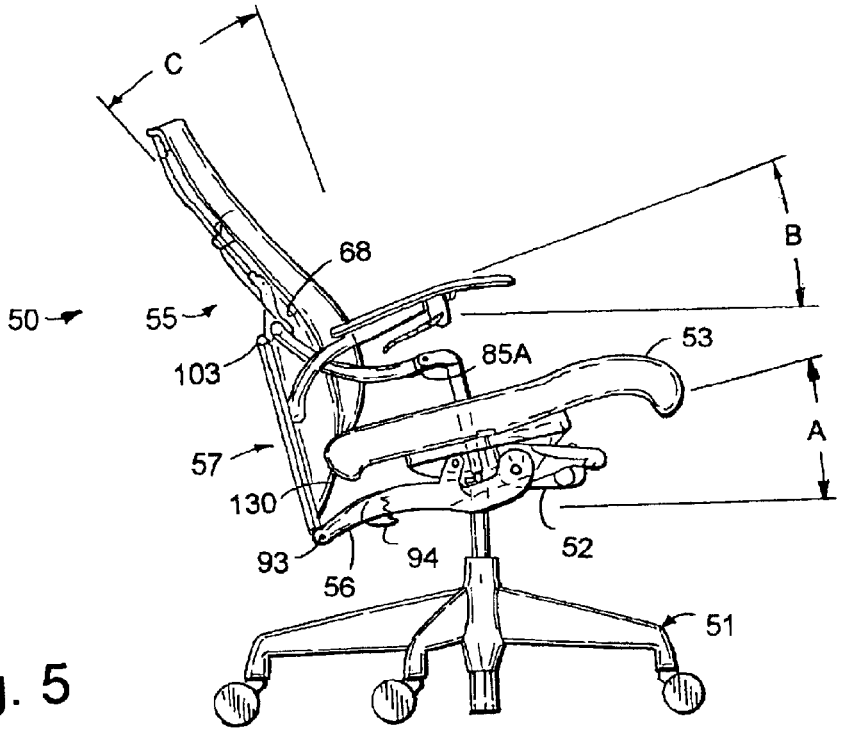
FIG. 5 is a side view of the chair similar to FIG. 1, but with the back and seat being shown in a reclined position.

A chair 50 (FIG. 1) embodying the present invention includes a base 51, a control 52 mounted on the base 51, and a seat 53 and a back tilt bracket 54 pivoted to the control 52 for synchronous movement during recline of a back construction 55. An extension 56 is adjustably supported on the back tilt bracket 54 to form a back tilt bracket subassembly, and is pivotally connected to a back support 57. The back support 57 is separately pivotally connected to a backrest frame 58, and the backrest frame 58 is separately pivoted to a seat support structure 82. The combination of the extension 56 and back tilt bracket 54 (as one unit), the back support structure 57, the backrest frame 58, and the seat support structure 82 of the seat 53 are connected in a four-bar linkage arrangement, as discussed below. Advantageously, the extension 56 is adjustable on the back tilt bracket 54 (see FIGS. 6 and 7) to change the angular position of the back 55 when in the rest or upright position, and further provides a secondary back tilt axis 93 that is located rearward of a rear edge of the seat 53. This provides a unique back movement upon recline that is more compliant with a seated user's body movements during recline than many reclineable chairs, as discussed below. The back support 57 includes a spine assembly 60 that is pivoted to a rear end of the extension 56 and that extends upwardly.

An armrest assembly 61 is operably supported on the spine assembly 60 for vertical adjustment by means of an armrest mount 62 on the spine assembly 60. A handle 63 on one of the armrests 64 is operably connected to a latch 65 on the armrest mount 62 via a tension cable for easy adjustment of the armrests 64. The arrangement of the backrest frame 58, the spine assembly 60, the back tilt bracket 54, and the seat 53 provides a unique synchronous movement that, among other things, pivots the armrests 64 at an angular rate between a rate of the seat 53 and the back 55 during recline of the back 55. The back 55 includes a flexible back shell 66 having a lumbar section, a lumbar slide 68 slidably engaging a rear surface of the back shell 66 and operably supported thereagainst for changing a vertical shape of the lumbar section, and lumbar side arms 69 engaging a rear surface of the back shell 66 and also operably supported thereagainst for changing a horizontal shape of the sides/lateral area of the lumbar section 67.

More specifically, the base 51 (FIG. 1) includes a floor-engaging bottom including a center hub 70 with radially extending legs 71 having castors 72 on their ends. A vertically adjustable center post 73 includes an extendable gas strut that extends from hub 70 and engages a housing 74 on control 52.

The control 52 is described below in sufficient detail for an understanding of the present invention. Nonetheless, it is noted that the control 52 is described in more detail in U.S. Pat. No. 5,630,647, issued May 20, 1997, entitled *Tension Adjustment Mechanism for Chairs*, which patent is incorporated herein by reference in its entirety. Notably, even though the present invention is described in combination with the control 52, the scope of the present invention is believed to include other chair controls and chair or back constructions. For example, the present invention is believed to be usable on chair controls that provide a synchrotilt motion to a seat and a back, and to be usable on other chairs having reclineable backs, other chairs having flexible backs providing postural support to a seated user, and other chairs having vertically adjustable armrests.

Figure 8:
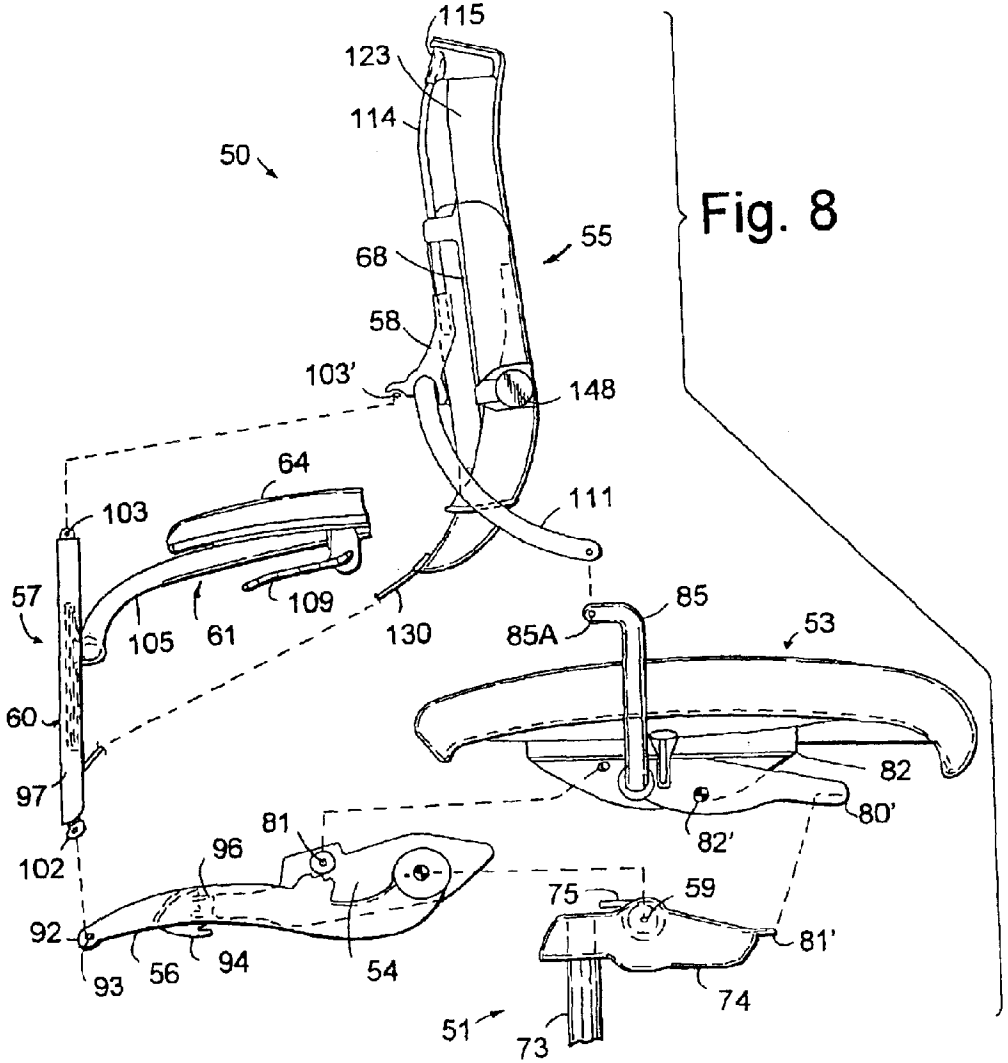
FIG. 8 is an exploded side view showing subassemblies of the chair that are pivoted together.
Figures 9, 10, 11, 12, 13, 14, 15, 16, 17, 18, 19, 20:
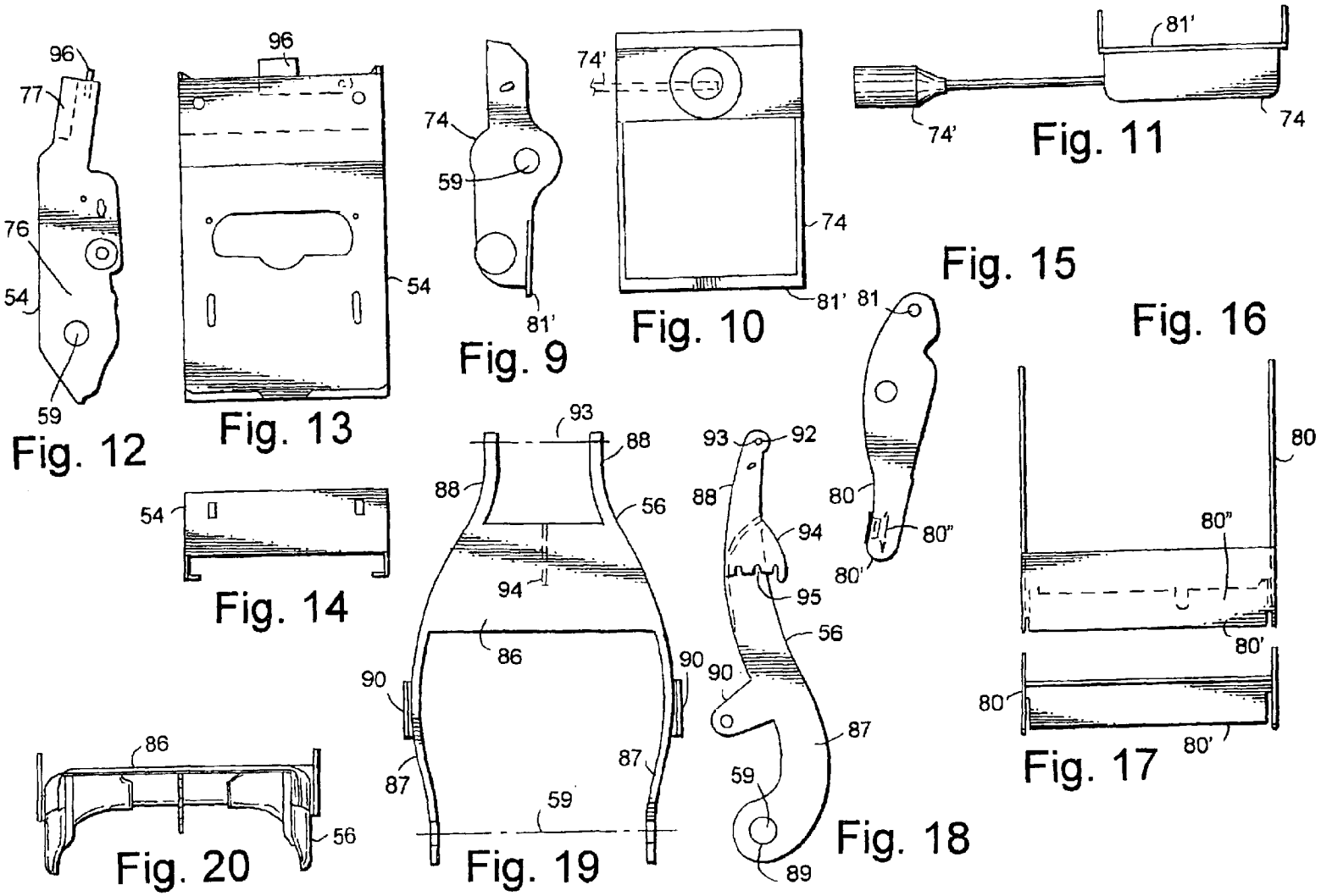
FIGS. 9–11 are side, top, and front views of the control housing shown in FIG. 1.
FIGS. 12–14 are side, top, and front views of the back tilt bracket shown in FIG. 1.
FIGS. 15–17 are side, top, and front views of the synchrotilt bracket position of the seat support shown in FIG. 1.
FIGS. 18–20 are side, top, and front views of the extension for attachment to the back tilt bracket.
Figure 21:
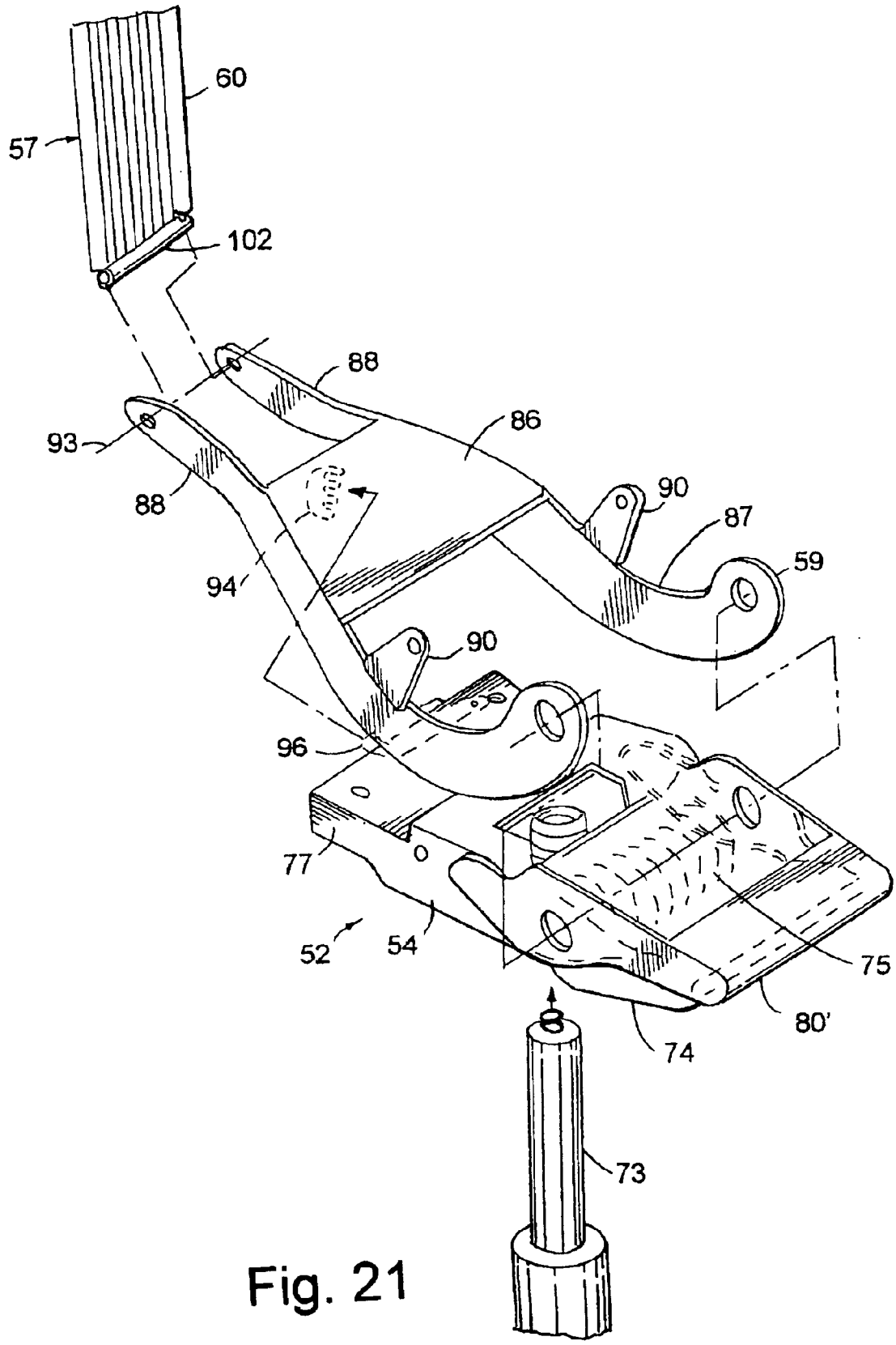
FIG. 21 is an exploded fragmentary perspective view of an upper part of the center post of the base, the control including the housing, the back tilt bracket and the energy spring, the extension, and the back support shown in FIG. 1.
Figures 21A, 21B, 21C:
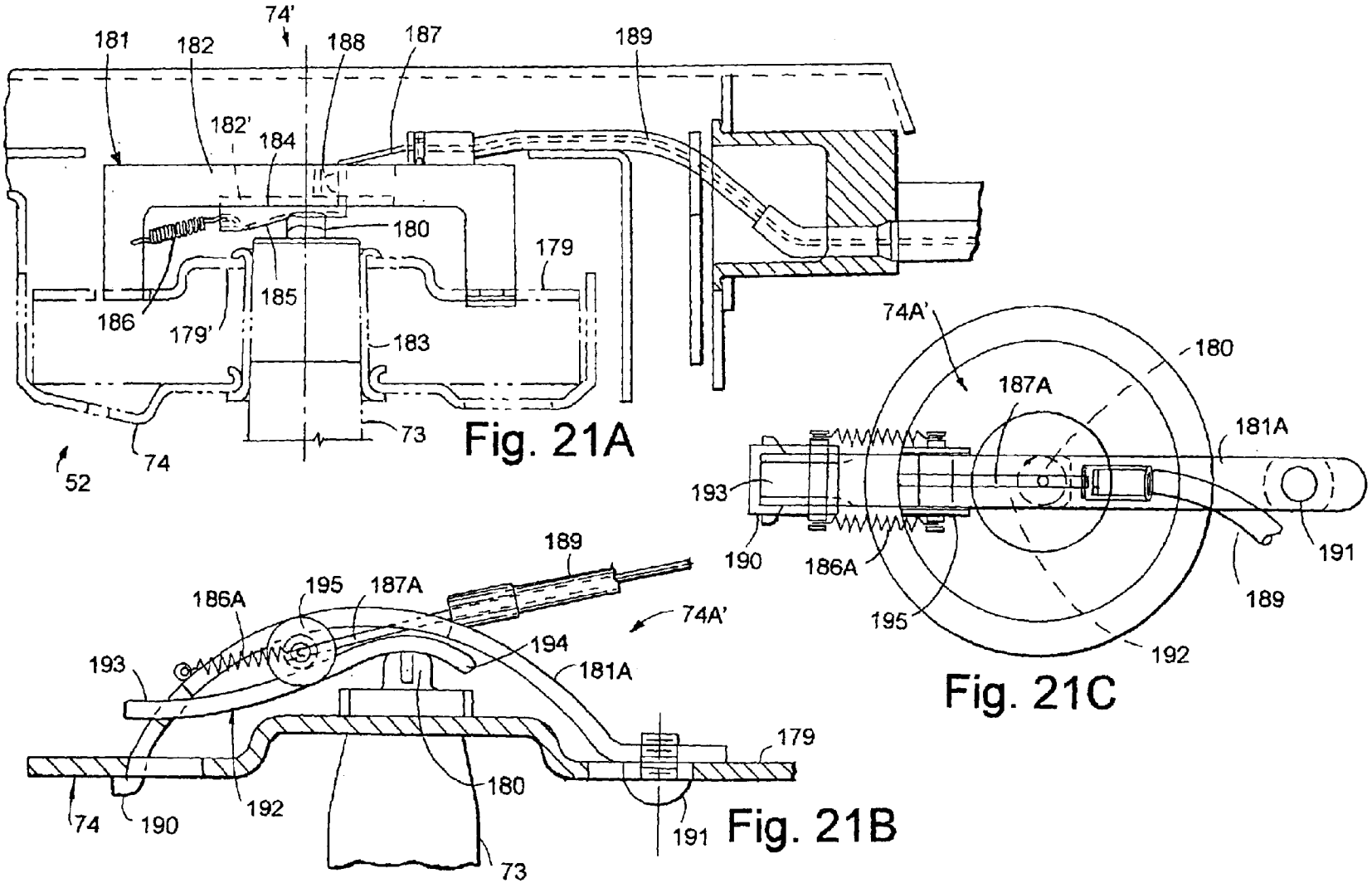
FIG. 21A is a cross-sectional side view of the control showing a vertical height adjustment mechanism and side actuator.
FIGS. 21B and 21C are fragmentary side and top views of another side actuator for the vertical height adjustment mechanism.
Figure 26:
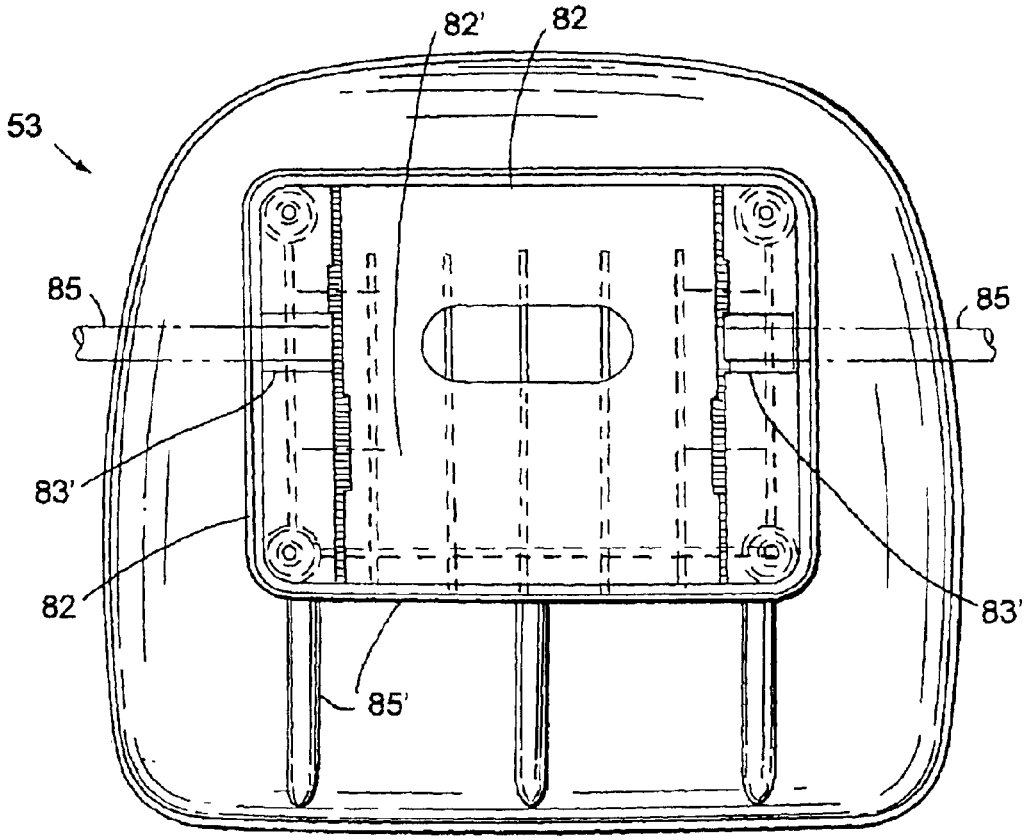
FIGS. 26–28 are bottom, front, and side views of the seat support shown in FIG. 22.
Figure 27:
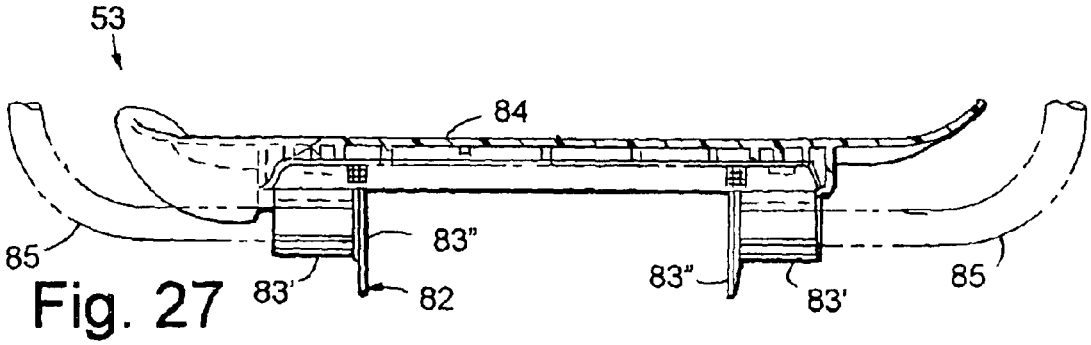
Figure 28:
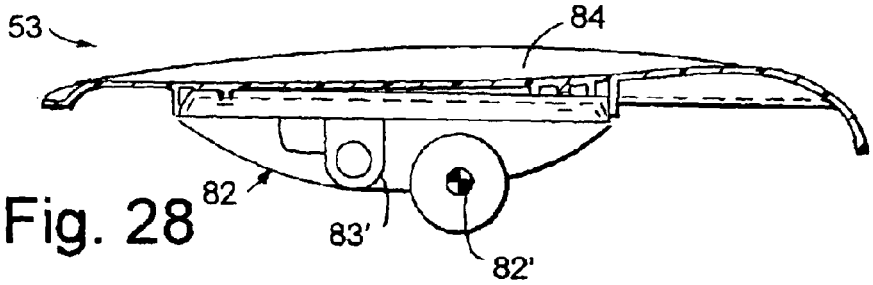

The control 52 includes the housing 74 (FIGS. 9–11), which is pan shaped and that includes a recess receiving an energy mechanism 75 (FIG. 21). A height adjustment mechanism 74' (FIG. 21A) is operably supported on housing 74 to operably engage a gas spring on base 51 for chair height adjustment. The back tilt bracket 54 (FIGS. 12–14) includes side flanges 76 pivoted to sides of the housing 74 at back tilt axis 59 by a tubular pin or bushing and a rearwardly extending tail section 77. Seat assembly 53 includes a synchrotilt bracket 80 (FIGS. 15–17) that pivotally engages the housing 74 at seat tilt axis 81. Synchrotilt bracket 80 has a nose 80' with a bushing 80" therein that slidably engages a front lip 81' on the housing 74. Seat assembly 53 (FIGS. 26–28) further includes a seat support structure or bracket 82 (FIGS. 23–25) for securely supporting a semi-rigid flexible seat shell 84 on the synchrotilt bracket 80. The seat support bracket 82 is pivoted to the synchrotilt bracket 80 at axis 82A for manual angular adjustment of the seat 53, and a latch mechanism 82" holds the seat 53 in a selected angular position on the synchrotilt bracket 80. The bracket 82 (FIG. 8) is pivoted to the synchrotilt bracket 80 at axis 82' and provides for manual adjustment of the seat 53 while the back 55 is in the upright position, including adjustment of the seat angle or of the seat depth. A seat cushion and fabric 83 (FIG. 1) are attached to the seat shell 84 (FIG. 22) to form a comfortable chair seat. Side supports 85 (FIG. 22) are fixed or welded to the seat support structure 82 at mounts 83' and extend upwardly on opposing sides of the seat support structure 82, and side flanges 83" stiffen the support structure 82. The side supports 85 are tubular and include upper end sections positioned at about a seated user's hip joint, and define an axis of rotation 85A (FIG. 1) aligned approximately with the seated user's hip joint, as described below. Notably, the back tilt axis 59 and the manual seat angle axis 82' may or may not generally align with one another. A seat depth adjustment mechanism 84' can also be provided on the seat 53. Seat shell 84 includes ribs 85' as needed.

The extension 56 (FIGS. 18–20) includes an H-shaped body having a transverse wall section 86, opposing forward arms 87, and opposing rearward arms 88. The forward arms 87 are spaced apart and include holes 89 configured to be pivoted to the sides of housing 74 at back tilt axis 59. Stabilizing tabs 90 extend from arms 88 at a location between the forward arms 87 and the transverse wall section 86. Stabilizing tabs 90 slidingly engage the sides of back tilt bracket 54 and help stabilize the vertical movement of the extension 56 on the back tilt bracket 54. Rearward arms 88 extend rearwardly from transverse wall section 86 and include apertures 92 defining a second back tilt axis 93. (Notably, additional apertures can be provided on rearward arms 88 for defining different locations for axis 93, if desired.) An E-shaped notched flange 94 is attached to the transverse wall section 86. The E-shaped flange 94 defines three notches 95 for selective engagement by a spring-biased movable tooth 96 (FIGS. 12 and 13) on the tail section 77 of the back tilt bracket 54. The movable tooth 96 can be actuated in different ways, such as manually by an operator grasping the tooth 96 or by a Bowden cable and lever actuator for remote actuation. The extension 56 (FIG. 21) is manually adjustably pivotable about the back tilt axis 59 by releasing tooth 96 from notched flange 94, by adjusting the extension 56 angularly relative to the back tilt bracket 54, and by engaging the tooth 96 into a newly selected notch 95. As described below, adjustment of the extension 56 raises (or lowers) the back support structure 57 (see FIGS. 6 and 7) and in turn raises (or lowers) the back 55, so that they are positioned to provide angularly different postural support when in the upright position.

Figure 29:
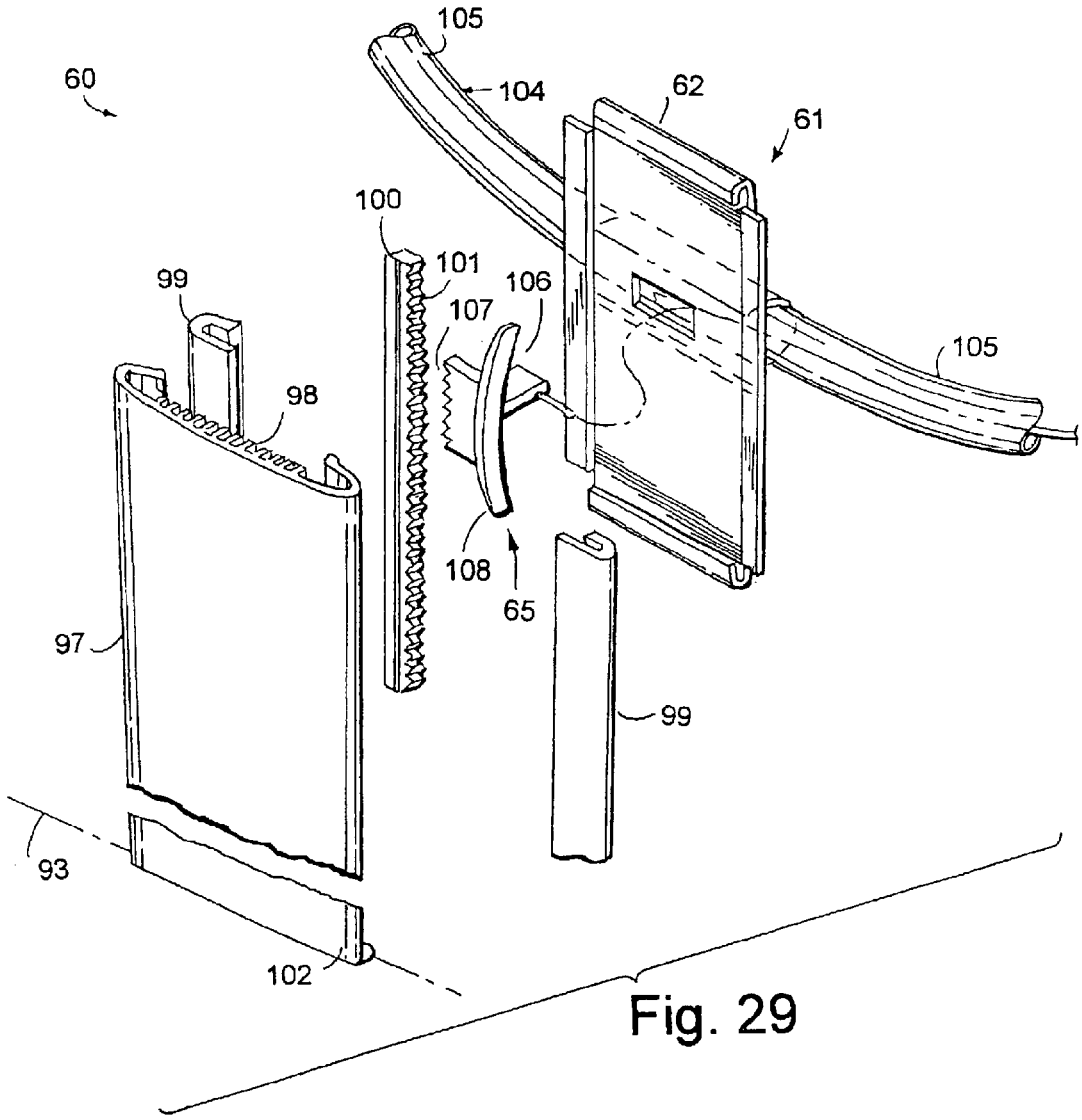
FIG. 29 is an exploded fragmentary perspective view of the back support/spine assembly and armrest assembly including the armrest latching mechanism.
Figure 32:
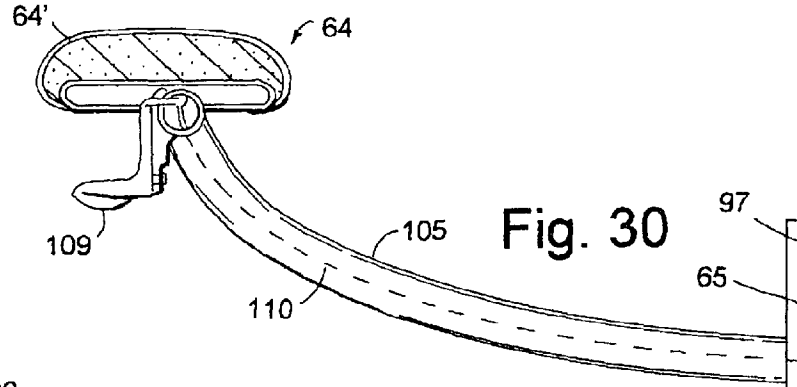
Figure 32:
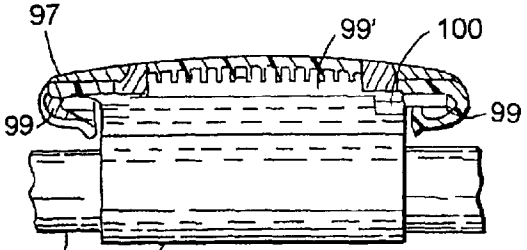
Figure 33:
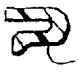
FIGS. 33 and 34 are top views of the bushing and stabilizer/follower, respectively, shown in FIG. 32.
Figure 34:
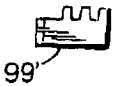
Figure 36:
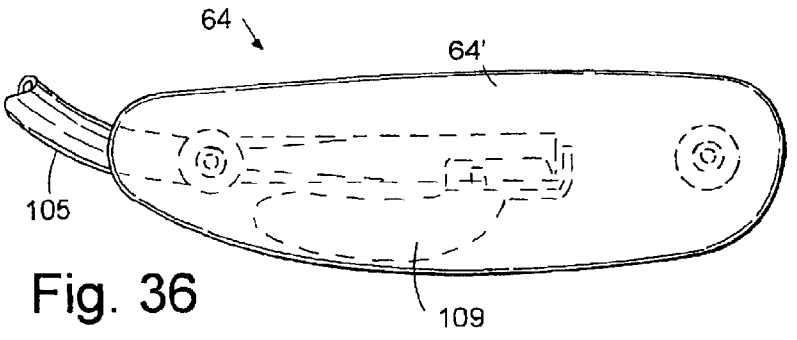
FIGS. 35–37 are side, top, and front views of the armrest assembly shown in FIG. 30.

Spine assembly 60 (FIG. 29) includes a vertical frame member 97 having a C-shaped cross section with stiffening ribs 98 formed integrally therein or attached to its concave side. Opposing C-shaped side bearings 99 are positioned along edges of the concave side, and a rack 100 having teeth 101 is also positioned on one side. A stabilizer 99' (FIGS. 32 and 34) extends from plate-like mount 62 into ribs 98 as noted below. The vertical frame member 97 defines a bottom pivot 102 for pivotal connection to holes 92 on extension 56 (FIG. 8) at second back tilt axis 93, and further defines a top pivot 103 for pivotally engaging the backrest frame 58 at axis 103', as described below.

Figure 30:
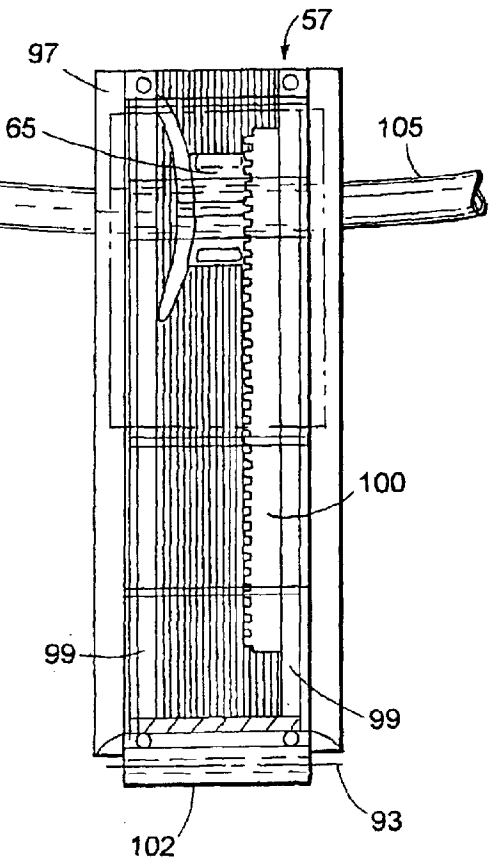
FIG. 30 is a fragmentary rear view of the components shown in FIG. 29.
Figure 31:
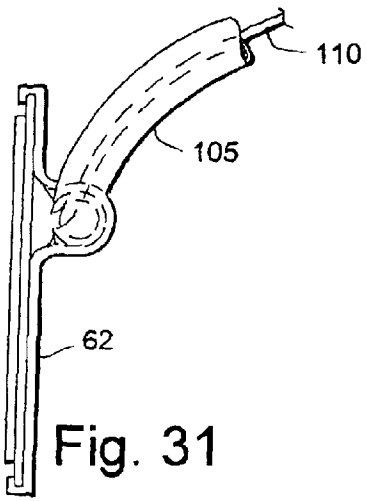
FIGS. 31 and 32 are fragmentary side and top views of the components shown in FIG. 30.
Figure 35:
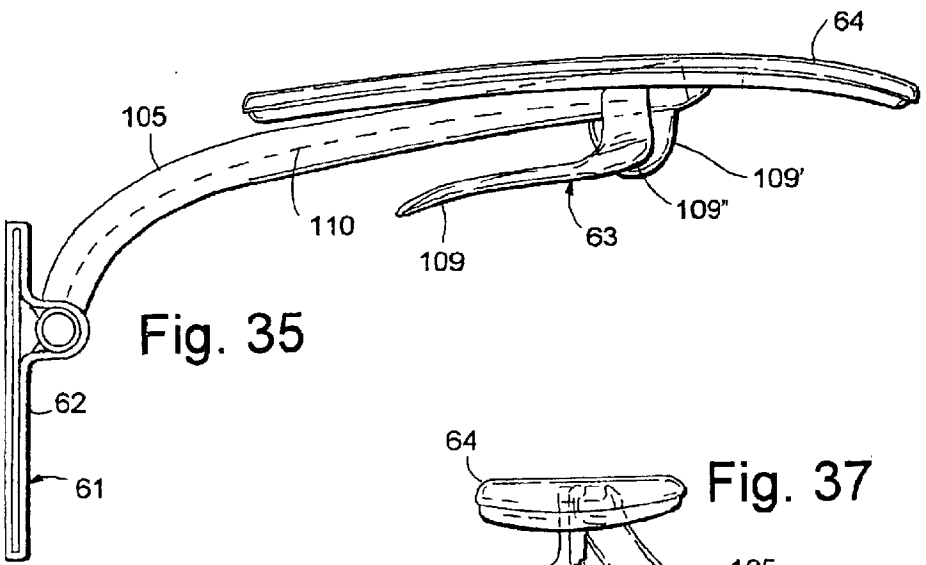
Figure 37:
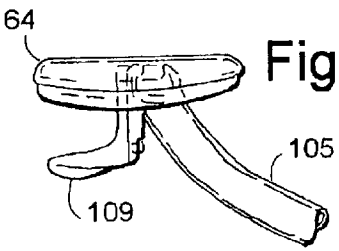
Figure 38:
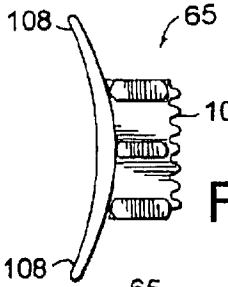
FIG. 38 is a front view of the latch member shown in FIG. 29.
Figure 39:
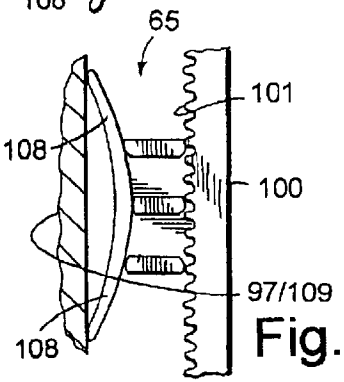
FIGS. 39 and 40 are fragmentary front views of the latch member shown in FIG. 29, FIG. 39 illustrating a latched position, FIG. 40 illustrating an unlatched position.
Figure 40:
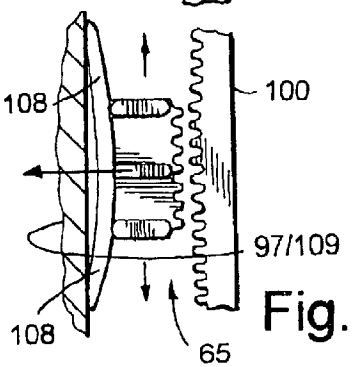

Armrest assembly 61 (FIG. 29) includes the plate-like mount 62 with side edges configured to slidably engage the side bearings 99 for vertical movement. Stabilizer 62 slidably engages frame member 97 to help stabilize the mount 62 on the spine assembly 60. A tubular armrest frame 104 is attached to mount 62 and includes side sections 105 that extend in a curvilinear fashion from the mount 62 around to a side of the chair 50. Armrests 64 (FIG. 30) including forearm support pads 64' are supported on ends of the side sections 105. The latch 65 (FIGS. 38–40) is slidably attached to mount 62 (FIG. 29) and includes a body 106 that slides on mount 62. The latch 65 further includes latching teeth 107 shaped to securely selectively engage the teeth 101 on rack 100, and spring feet 108 bias the latching teeth 107 into engagement with the teeth 101 on rack 100 (see FIGS. 38–40). The right (or left) side section 105 (FIG. 35) includes a down flange 109' that extends downwardly below one of the armrests 64, and a finger-actuateable lever 109 of handle 63 is pivoted to the down flange 109' at a pivot axis 109". A telescoping Bowden cable 110 is operably connected between an end of the lever 109 and the latch 65. By squeezing and thus pivoting the lever 109, the cable 110 that extends through side section 105 is tensioned and the latch 65 is biased to a release position (FIG. 40) as the spring feet 108 compress. When the lever 109 is released, the spring feet 108 bias the cable 110 to a normally retraced position (FIG. 39). Notably, the handle 63 provides a distinctive appearance resembling a bicycle brake handle and is actuateable much like a bicycle brake handle. It is contemplated that the present adjustable armrest can also be actuated by different means, and further that the present actuator can be used with various adjustable armrests, such as armrests that are adjustable laterally, longitudinally (i.e., fore-to-aft), vertically, rotationally, and/or in other ways known in the art.

As described below, the back support 57 including the spine assembly 60 (FIG. 8) forms part of a four-bar linkage that operably supports the back 55 and seat 53 for synchronous movement during recline of the back 53, the back support 57 and spine assembly 60 being one of the links that extends between the back 55 and the seat 53. In the four-bar linkage arrangement, during recline of back 55, the spine assembly 60 rotates at an intermediate rate between the angular rate of rotation of the seat 53 and back 55. Due to the attachment of the armrest assembly 61 to spine assembly 60, the armrest assembly 61 also moves at the intermediate rate of rotation, the ratio of the angular movement of the back, the armrest, and the seat being about 2:1.5:1. The actual angular movements "A," "B," and "C" of the seat, armrest, and back during recline are about 12°, 17°, and 22°, respectively, in the illustrated chair 50 (FIG. 5). Notably, by changing a height of the armrest assembly 61, the angular rate of rotation does not change, although the rearward movement and path of translation of the armrest assembly 61 changes due to a longer (or shorter) distance of the armrest assembly 61 from second back tilt axis 93. By changing angular position of the extension 56 by means of E-flange 94 and tooth 96, or by selecting a different hole location for axis 93 in the extension 56, the location of the second back tilt axis 93 can be changed to provide still another different movement of the back 55 and movement of the armrest assembly 61.

Figure 1:
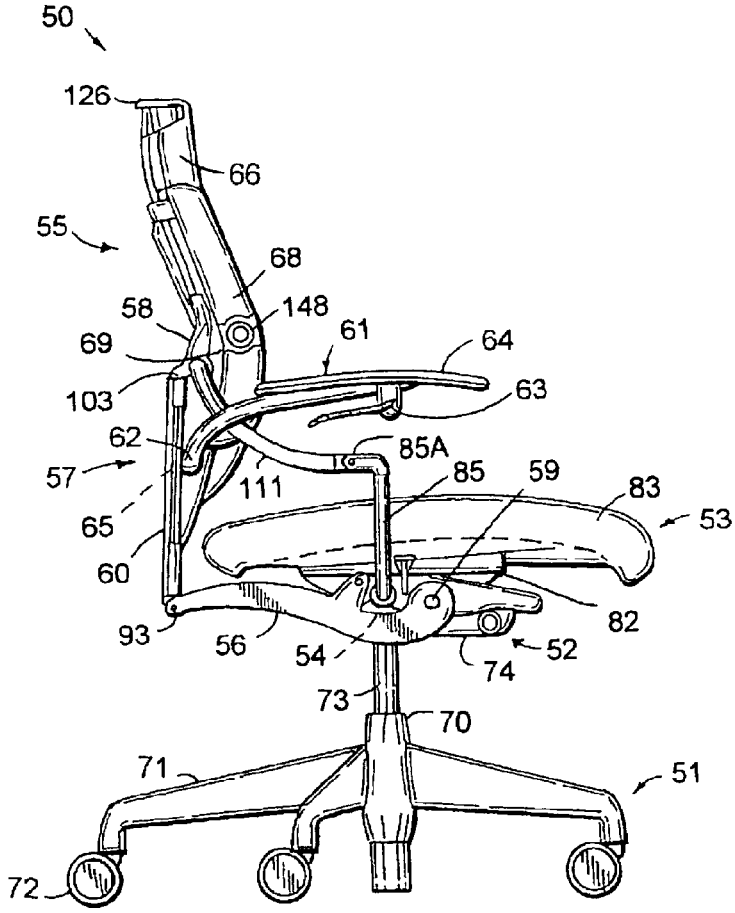
FIG. 1 is a perspective view of a chair embodying the present invention, the chair being in an upright position with its back adjusted to a first upright position, and with the vertically slidable lumbar adjustment mechanism adjusted to a lowered position.
Figure 2:
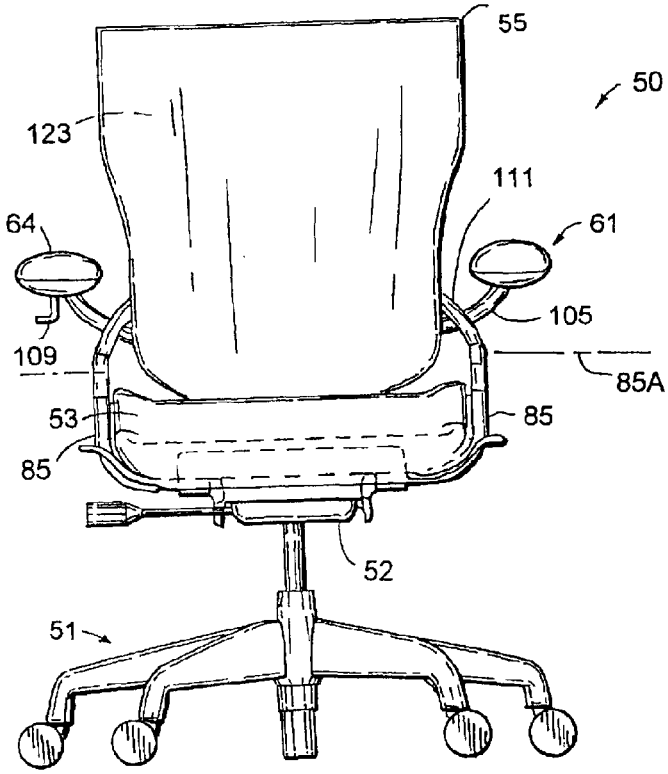
FIGS. 2–4 are front, top, and rear views of the chair shown in FIG. 1.
Figure 3:
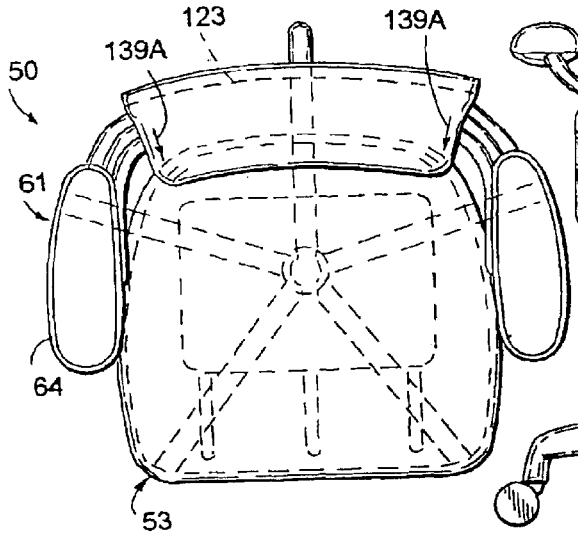
Figure 4:
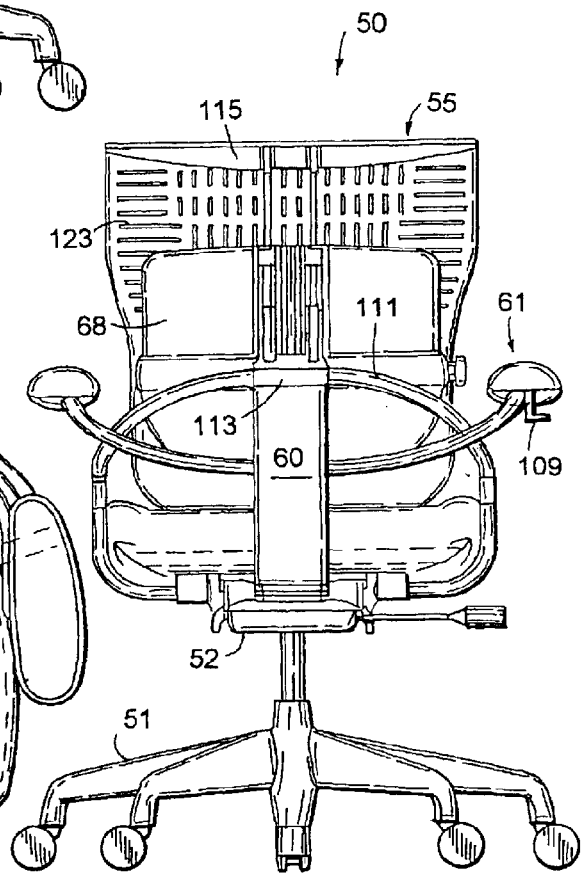
Figures 41, 42, 43, 44:
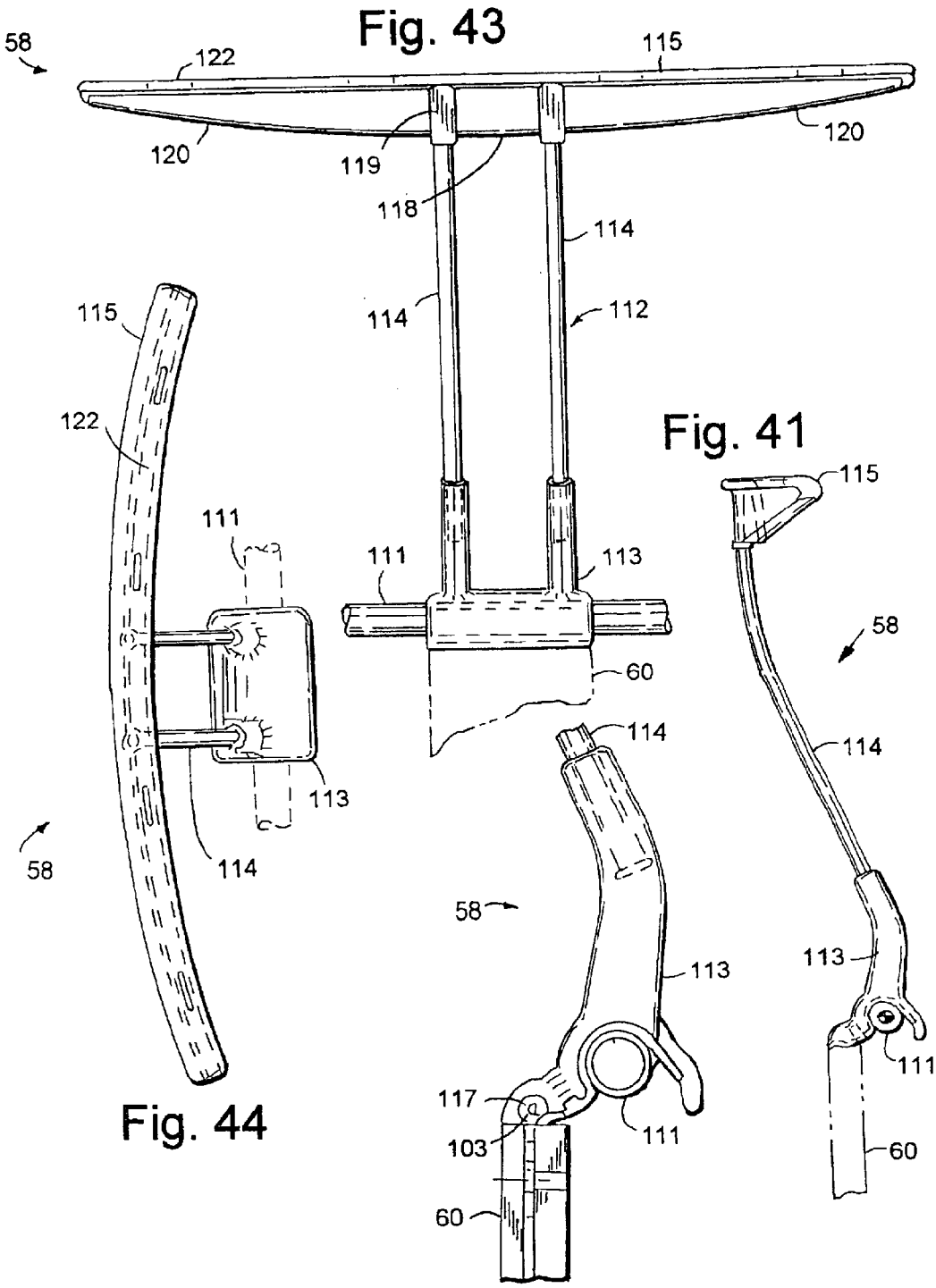
FIGS. 41–44 are side, enlarged side, rear, and top views of the backrest frame shown in FIG. 1.
Figure 45:
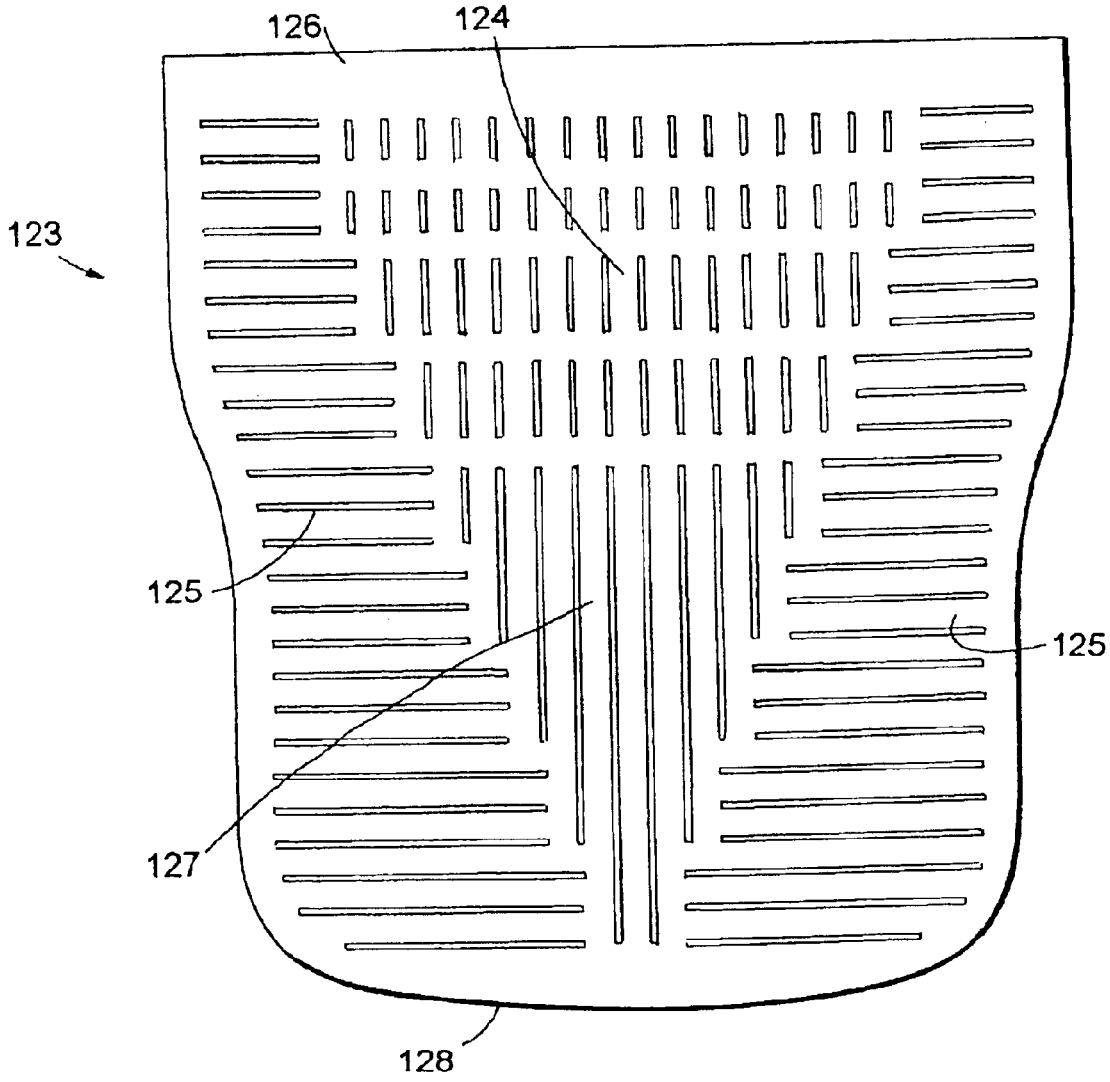
FIG. 45 is a front view of the backrest shell shown in FIG. 4.
Figure 46:
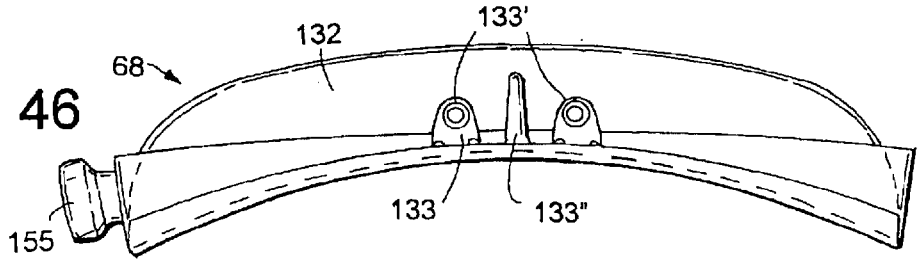
FIGS. 46–49 are top, front, rear, and side views of the vertically adjustable lumbar slide shown in FIG. 1.
Figure 47:
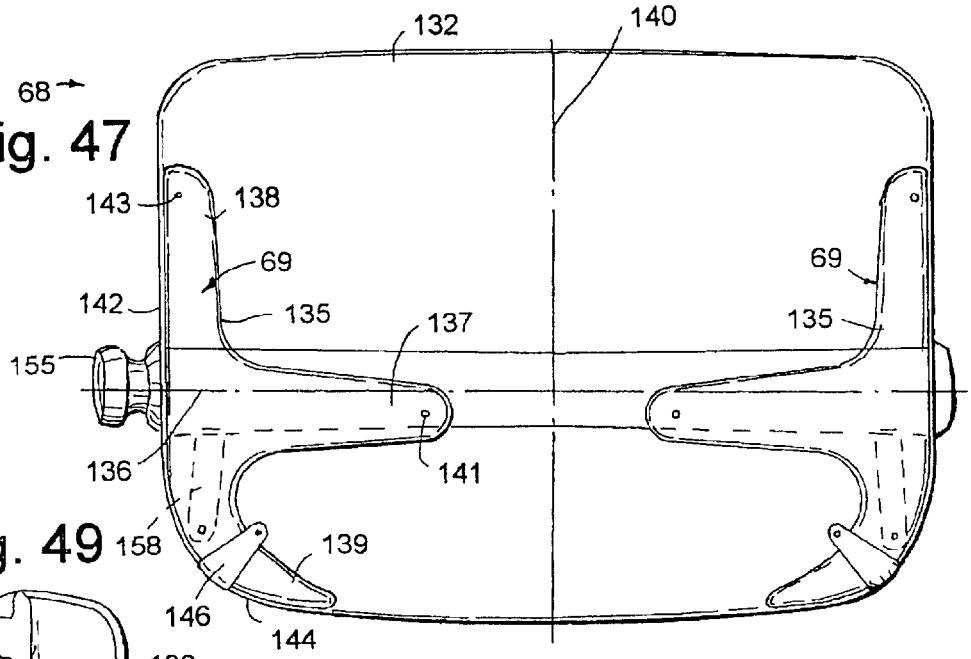
Figure 49:
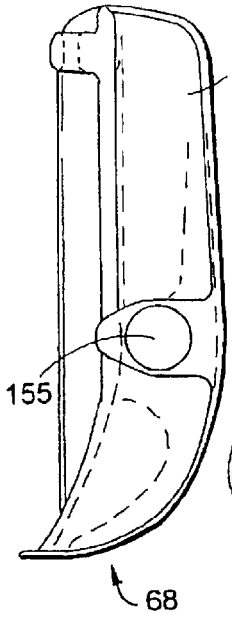
Figure 48:
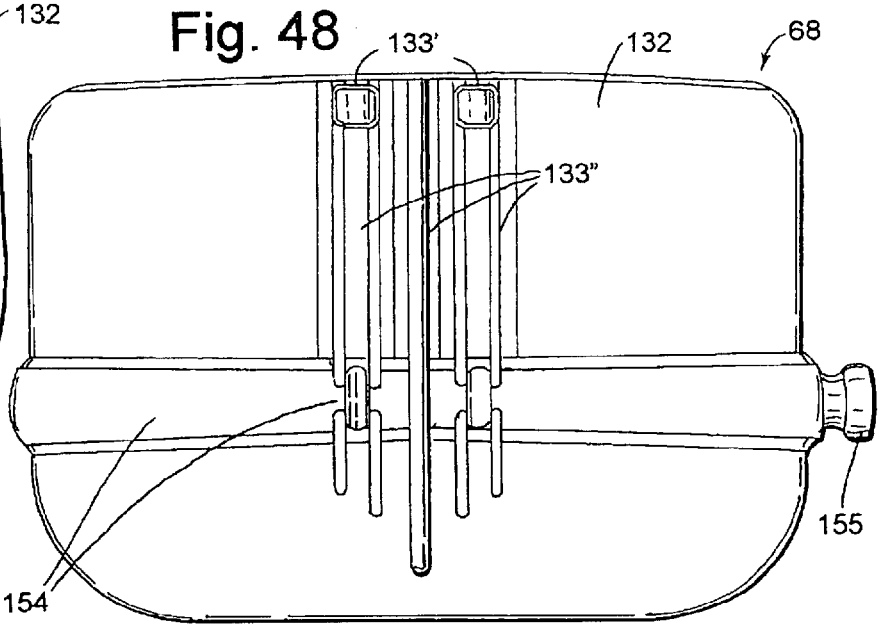

The backrest frame 58 (FIGS. 41–44) includes a tubular frame member 111 (FIGS. 1 and 43), and further includes a rod extension assembly 112. The rod extension assembly 112 includes a knuckle 113 fixed to a center of the tubular frame member 111, a pair of rods 114 that extend upwardly from knuckle 113, and a top bracket 115 that engages a top of the rods 114. The tubular frame member 111 (FIG. 1) includes opposing ends that wrap around to sides of the chair 50 and that are pivoted to top end sections of the side supports 85 on seat 53 at hip axis 85A (FIG. 1). The tubular frame member 111 is located inboard of the side supports 105 of the armrest frame 104, so that the backrest frame 58 does not interfere with the armrest frame 104 despite the range of positions that each may be located in during recline of the back 55. The knuckle 113 (FIG. 42) includes a pivot recess 117 that pivotally engages the upper end of the spine assembly 60 at top pivot 103 to define a third axis of rotation. The top bracket 115 (FIG. 43) includes a center section 118 with bosses 119 for receiving the upper ends of the rods 114, and further includes side wings 120 that extend laterally to side edges of the back 55. The top bracket 115 includes reinforcement ribs as needed for stiffness, and includes a radiused front surface 122 for receivingly attaching a top of the back shell 123 (FIGS. 45 and 3) described below. The top bracket 115 is further arcuately shaped for aesthetics and functional support to a seated user. The rods 114 are shaped to act as vertical guides to the vertically adjustable lumbar slide 68, as described below. The backrest frame 58 is semi-rigid but torsionally flexible enough to provide some twisting flexure when a seated user reclines the back 55 and twists/rotates his/her upper body.

The back construction 55 includes a flexible back shell 123 (FIG. 45) that comprises a flexible flat sheet, such as a sheet made of polypropylene or similar engineering type polymer. Where the sheet is translucent or transparent, the back construction 55 has a novel appearance, and further, it provides a functional result in that the adjusted position of the back construction 55 can be easily seen. The flat sheet includes a center section filled with a pattern of short vertical slots 124 forming a V-shaped arrangement with lower slots 124 being longer than upper slots 124, and includes side sections filled with a pattern of short horizontal slots 125 generally covering the remainder of the sheet, the lower slots 125 also being longer than the upper slots 125. The slots 124 and 125 are arranged to provide a desired level of postural support and twisting/torsional flexibility. An upper edge 126 of the flexible back shell 123 wraps onto a front surface of the top bracket 115 (FIG. 3) and is fixed to the top bracket 115. A horizontal central/lumbar area 127 (FIG. 6) of the flexible back shell 123 is supported by the lumbar slide 68 on the rods 114, as described below. A lower edge 128 (FIG. 6) of the flexible back shell 123 is anchored to lower area on the spine assembly 60 at location 129 by an elastic tensioner 130. The tensioner 130 can be made of any number of different stretchable or extendable/retractable materials or structures, such as a sheet of rubber elastomer, neoprene, spring steel, or the like. The tensioner 130 can be covered with fabric or colored as desired for aesthetics.

The lumbar slide 68 (FIGS. 46–49) includes a rigid body 132 positioned on and slidably engaging a rear surface of the back shell 123 (FIG. 6) and a top mount 133. The top mount 133 includes tubular sleeves 133' that are slidably engaged with the rods 114 for vertical adjustment between a top position (FIG. 7A), a bottom position (FIG. 6), and anywhere therebetween. Ribs 133" further stiffen the rigid body 132. It is contemplated that depressions can be located on the interfacing surfaces between the lumbar slide 68 and back shell 123 for forming a detent thereon, but at present it is contemplated that the frictional engagement between the two interfacing surfaces and between the lumbar slide 68 and the rods 114 is sufficient to hold the lumbar slide 68 in a selected vertically adjusted position. The rigid body 132 is sufficiently rigid and the back shell 123 is sufficiently flexible so that by engaging the rigid body 132 at different heights on the rear surface of the back shell 123, the back shell 123 changes shape in its lumbar area. This change in shape is assisted by the tensioner 130 which tensions the back shell 123 as the tensioner 130 pulls the lower edge 128 of the back shell 123 downwardly and rearwardly, causing the back shell 123 to be draped downwardly and against a front surface of the rigid body 132 of the lumbar slide 68. The top mount 133 is movable between the top bracket 115 and the knuckle 113 in a manner that limits the vertical adjustability of the lumbar slide 68. The lumbar slide 68 is adjusted manually by grasping handle 155 or mount 133 or other part of the lumbar slide 68 and then pulling upwardly or downwardly. There is enough friction on the lumbar slide 68 to hold it in a selected position.

Figures 6, 7A:
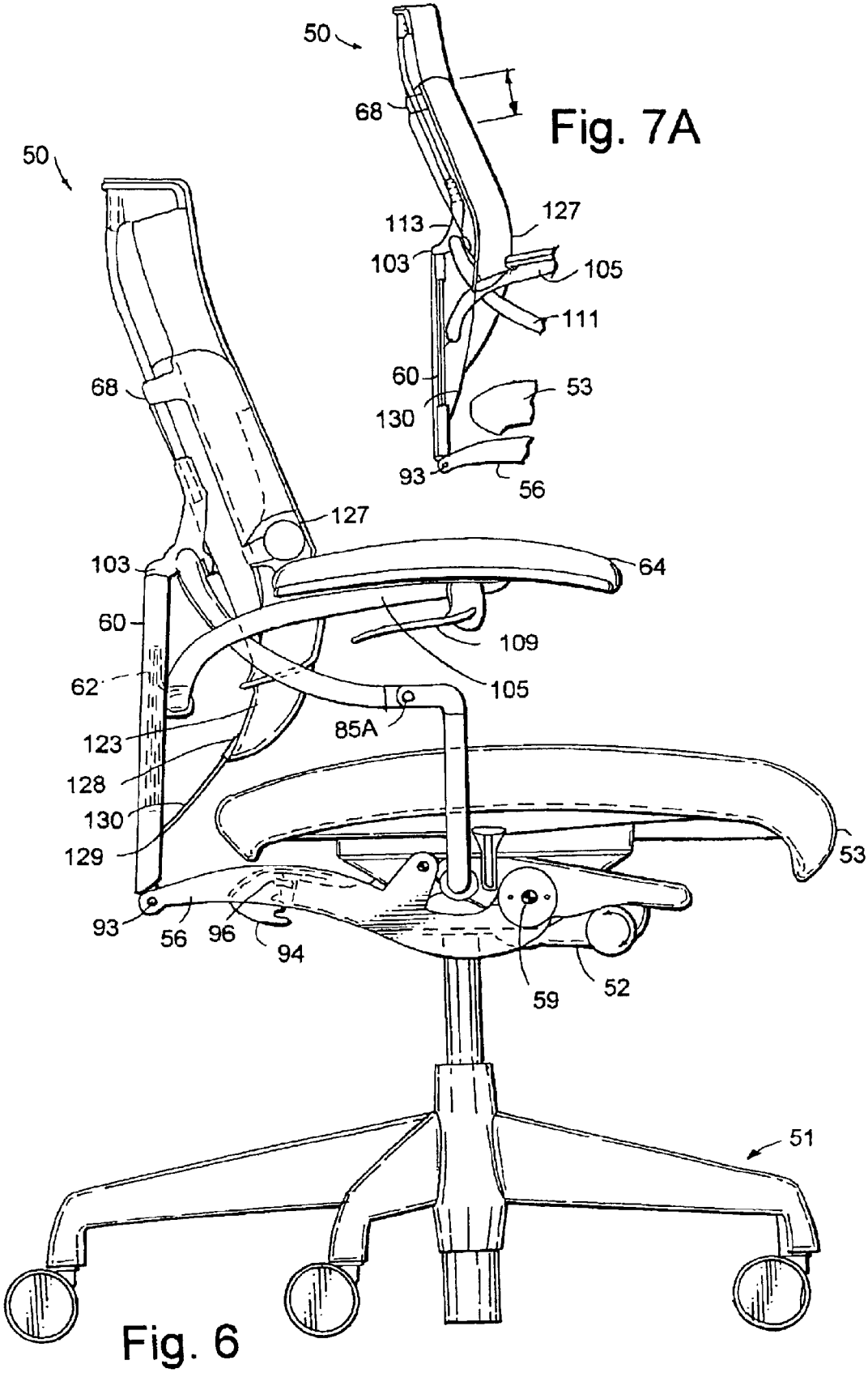
FIG. 6 is a side view of the chair in the first upright position similar to FIG. 1, but with hidden portions of the chair being shown.
FIG. 7A is a fragmentary side view of the chair similar to FIG. 6, but with the vertically slidable lumbar adjustment mechanism adjusted to a raised position.
Figure 7:
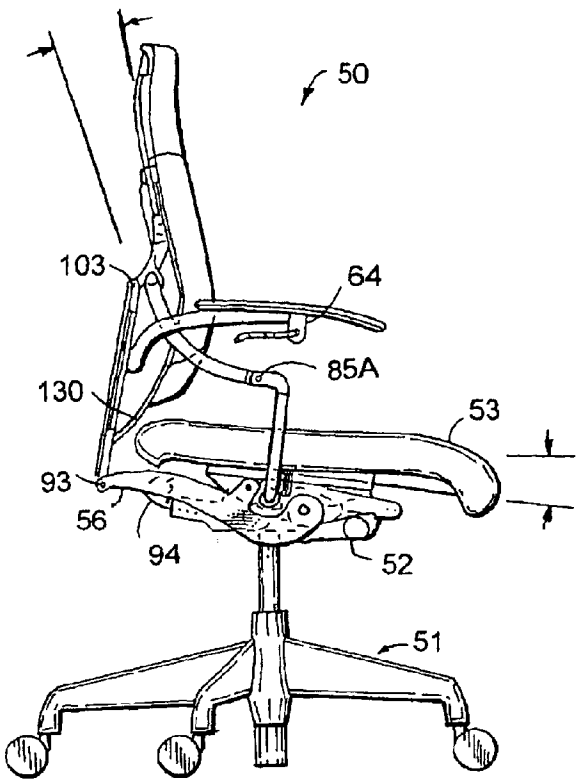
FIG. 7 is a side view similar to FIG. 6, but with the back and seat adjusted to a second upright position that is located above and forward of the first upright position in FIG. 6, and with the vertically slidable lumbar mechanism being shown in a middle location.

The fact that the slide 68 is moving on a near vertical plane as shown in FIG. 7A in combination with back 66 and the tensioner 130 results in an automatic change of seat depth of as much as 2 inches when the lumbar slide 68 is vertically adjusted. Specifically, one of the strong features of the design is the depth increase to the seat when the slide 68 is raised, and decrease when the slide 68 is lowered. Normally, tall people want the slide 68 elevated, and short people want it lowered. Hence, seat depth is automatically accomplished in this new arrangement.

The lumbar adjustable side arms 69 (FIG. 47) include a pair of opposing T-shaped sheet members 135 cut from a semi-rigid, resiliently flexible material such as nylon, stiff polymer, stiff metal, or the like. The sheet members 135 are attached to a front surface of the rigid body 132 on opposite sides. In particular, the sheet members 135 include a body section 136, with legs 137–139 extending from body section 136. The first leg 137 extends inwardly about two-thirds of the way toward a vertical centerline 140 of the rigid body 132 and is attached at location 141. The second leg 138 extends upwardly along a mid-perimeter section 142 of rigid body 132 and is attached at location 143. The third leg 139 extends downwardly along a lower corner perimeter section 144 of the rigid body 132 and extends a short distance around the lower corner. A strap 146 is attached to rigid body 132 at lower corner 144 and defines a slit-like open area thereunder, which defines a guide for leg 139 between the rigid body 132 and the strap 146. The third leg 139 extends slidably under the strap 144 through the open area. When third leg 139 is pulled toward second leg 138, the body section 136 bulges forwardly in direction "F" (see FIG. 53), causing the adjacent area on back shell 123 to flex forwardly. By adjusting the bulge of body section 136, the lateral side support provided to a seated user in the kidney area/side lumbar area is varied. In other words, by pulling third leg 139 toward second leg 138, the body section 136 causes an edge section of the back shell 123 to wrap partially around a seated user's lumbar area, thus providing side and lateral support to the seated user. This is accomplished completely from a rear of the back shell 123, without intruding onto a front side of the back shell 123.

Figure 50:
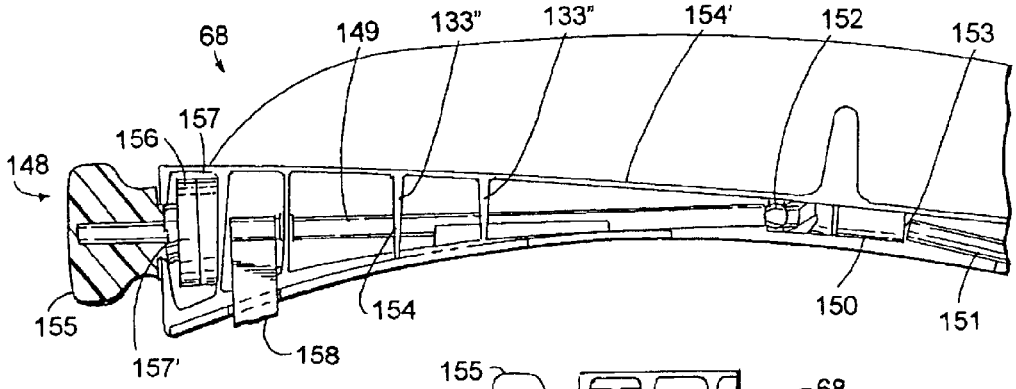
FIGS. 50 and 51 are top cross-sectional views of the lumbar side support arms and adjustment mechanism shown in FIG. 1, FIG. 50 showing the adjustment mechanism in a locked position and showing the transverse drive train device, and FIG. 51 showing the adjustment mechanism in an unlocked position permitting adjustment.
Figure 51:
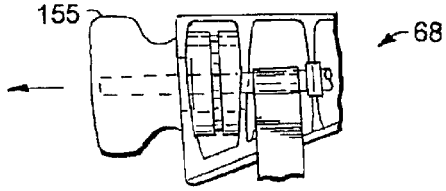
Figure 52:
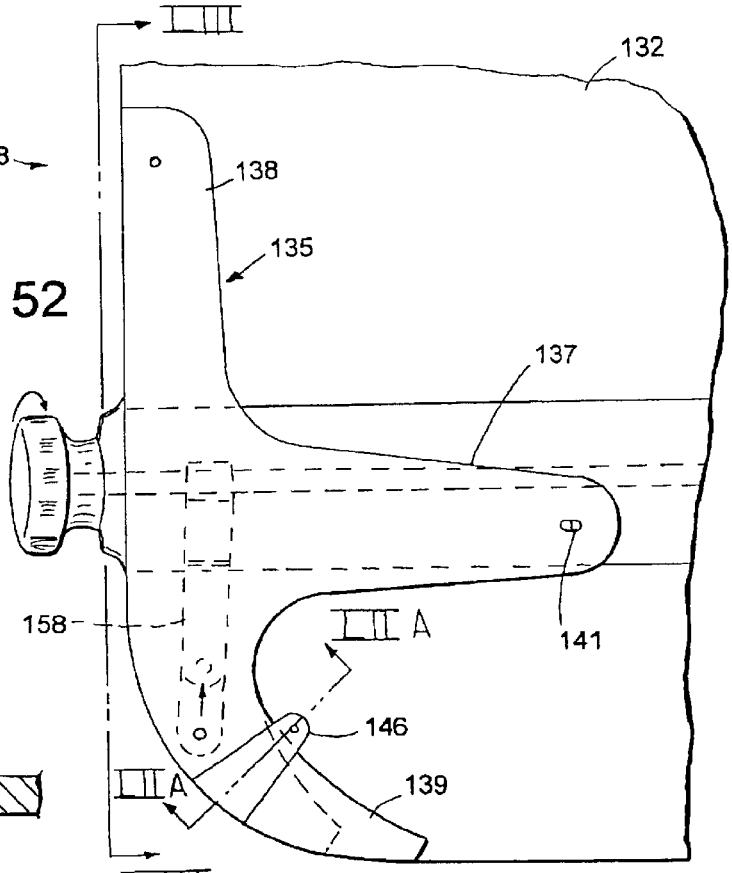
FIG. 52 is a fragmentary front view of the lumbar side support and adjustment mechanism shown in FIG. 50.
Figure 52A:
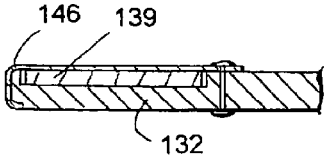
FIG. 52A is a cross-sectional view taken along line LIIA—LIIA in FIG. 52.
Figure 53:
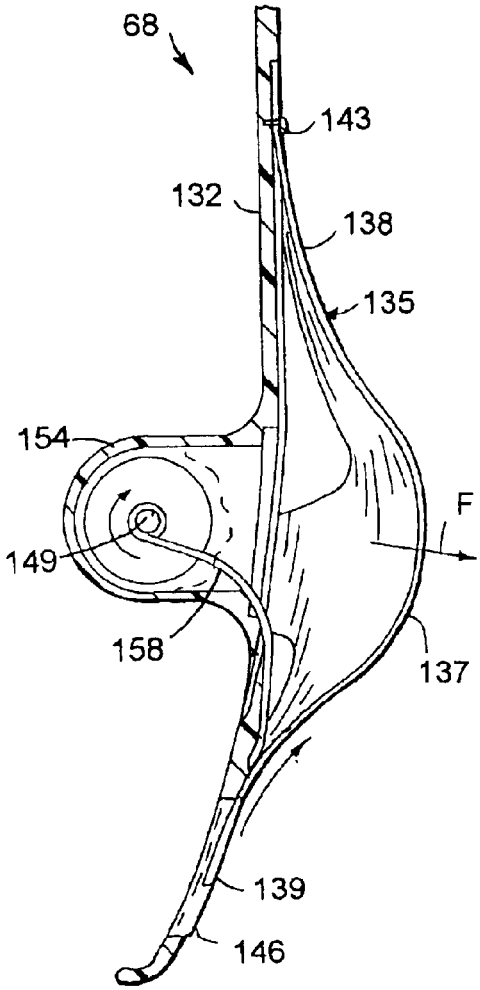
FIGS. 53 and 54 are cross-sectional side views taken along line LIII—LIII in FIG. 52, FIG. 53 showing the lumbar side support arms adjusted to a forwardly bowed condition to provide a high level of side/lateral lumbar support, and FIG. 54 showing the lumbar side support arms adjusted to a relaxed, semi-planar condition for providing minimal side/lateral lumbar support.
Figure 54:
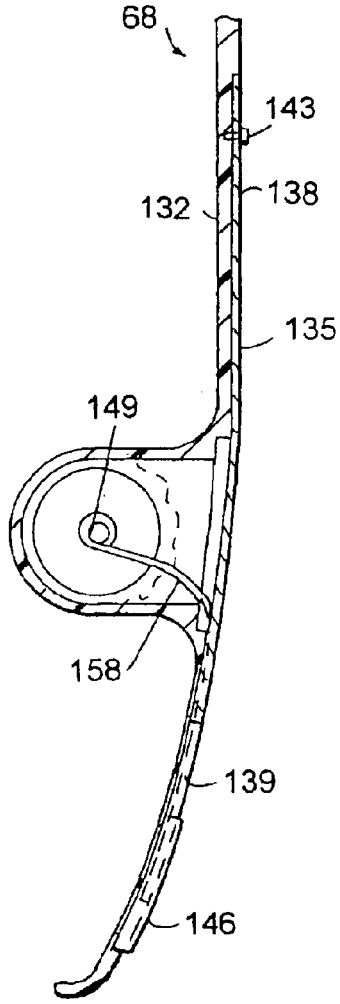
Figure 55:
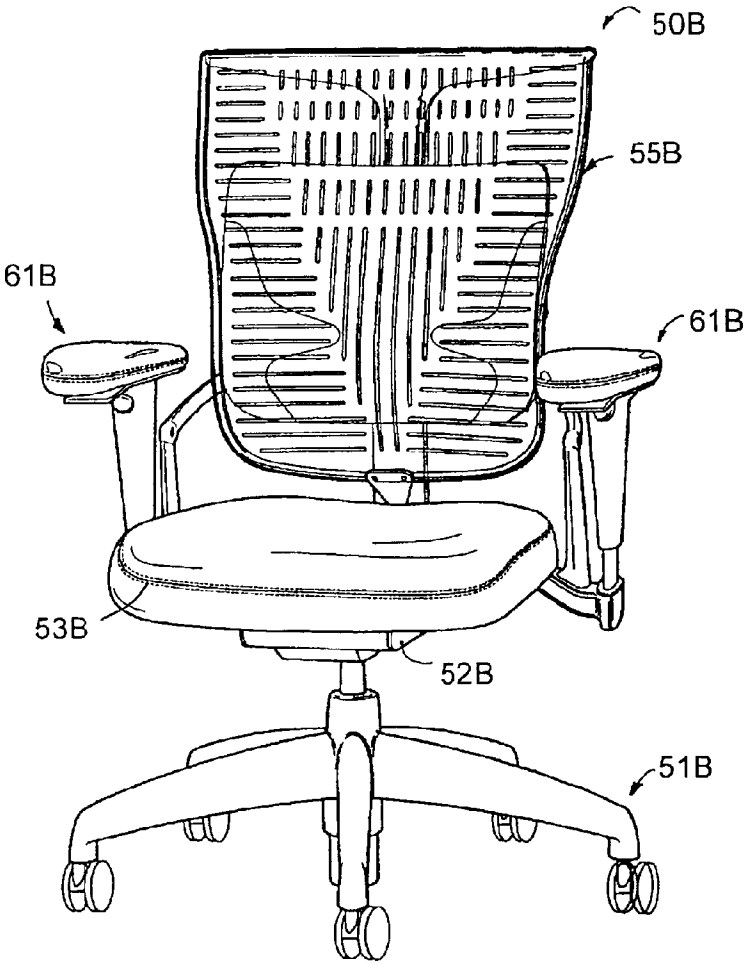
FIGS. 55–59 are perspective, front, side, top and rear views of a modified chair embodying the present invention.
Figure 56:
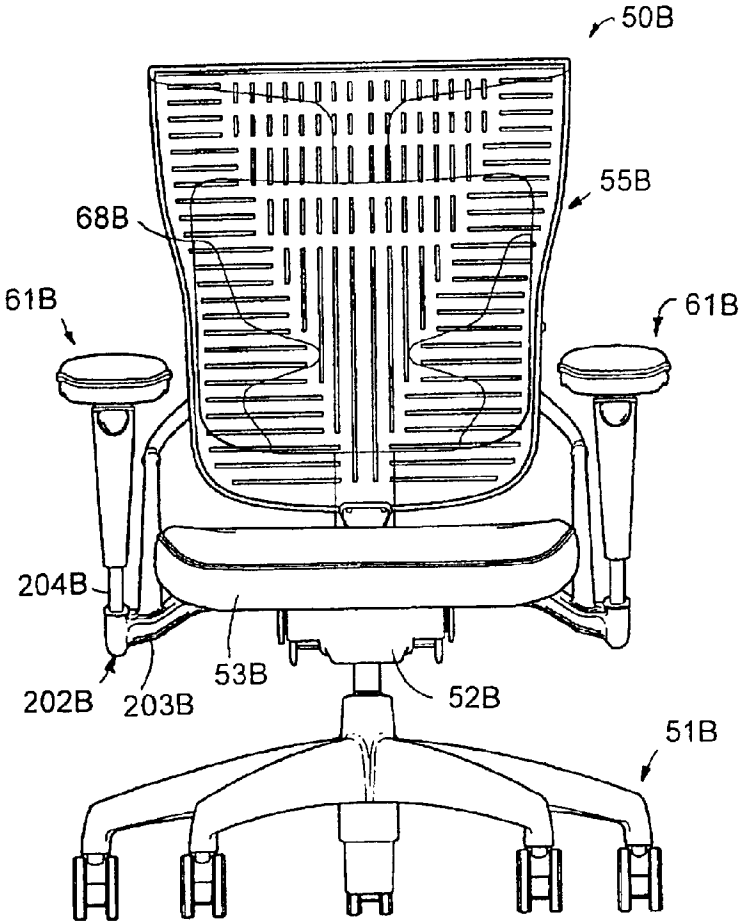
Figure 59:
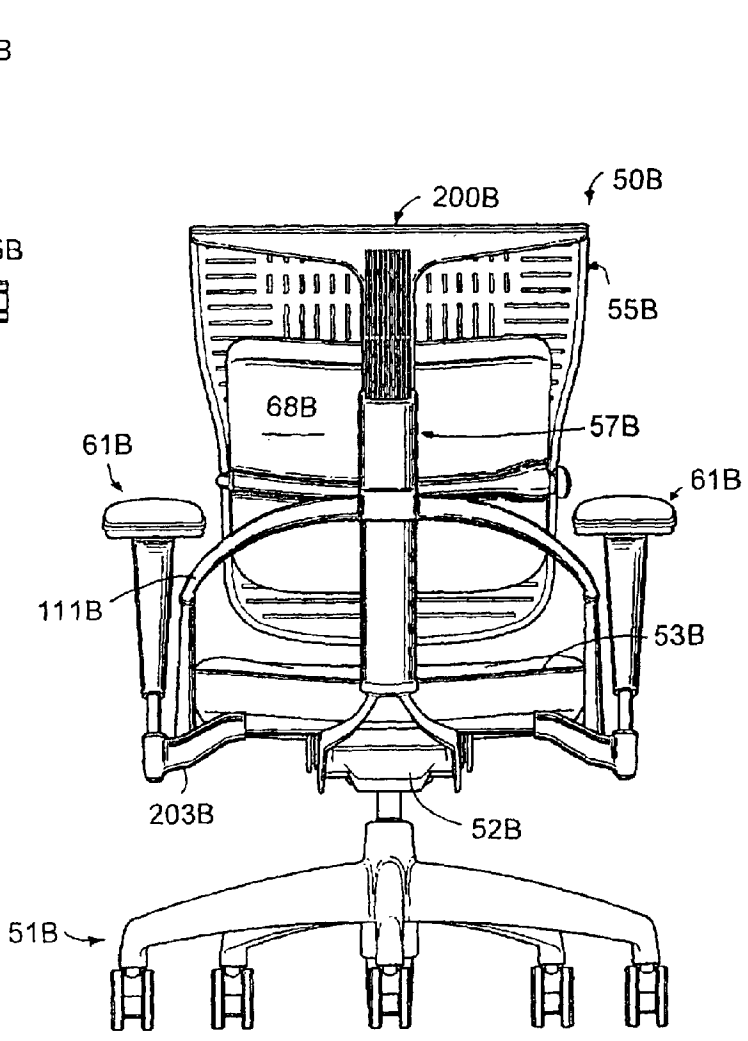
Figure 58:
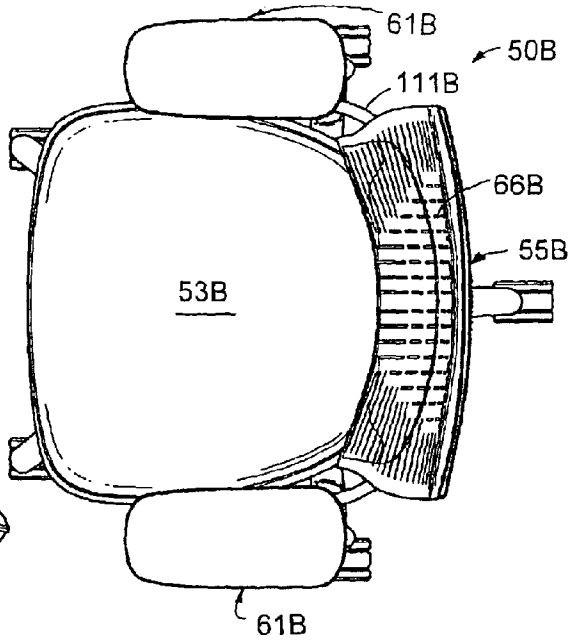
Figure 57:
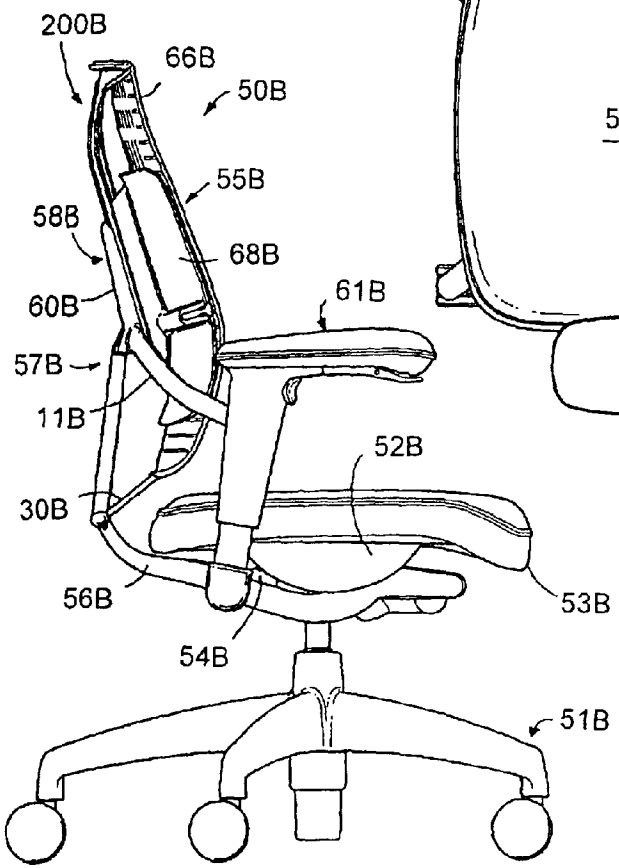

The "bulging" or forward movement of body section 136 at its side lumbar area is controlled by a lumbar adjustment mechanism 148 (FIGS. 50–52). The lumbar adjustment mechanism 148 (FIG. 50) includes a horizontal rotatable drive train formed by right rod 149, center link 150, and left rod 151. The rods 149 and 151 are connected to center link 150 by hex-shaped socket and hex-shaped ball universal connections 152 and 153. The drive train extends transversely across the lumbar slide 68, and is operably supported in a groove or recess 154 formed on the back of lumbar slide 68 by a ribbed housing 154'. The ribbed housing 154' includes ribs 133' that rotatably support the rods 149 and 151 of the drive train. A handle 155 is non-rotatably attached to one end of rod 149, but is slidably supported on the rod 149 for axial movement. A pair of friction clutch wheels 156 and 157 with intermeshing teeth are positioned on rod 149, with one wheel 156 being attached to handle 155 for axial movement on rod 149 and the other wheel 157 being non-rotatably attached to rod 149. A spring 157' biases the wheels 156 and 157 into engagement with each other when handle 155 is released. A strap 158 of spring steel or the like extends from rod 149 (FIG. 47) downwardly to the third leg 139, and a second strap 158 extends from rod 151 downwardly to its respective third leg 139. When handle 155 is axially moved to disengage the wheel 156 from the wheel 157 and is then rotated, rods 149 and 151 are also rotated, causing the straps 158 to wrap around the rods 149 and 151 (compare FIGS. 53 and 54). As the effective length of the straps 158 and 159 are shortened due to their length being wound around the rods 149 and 151, the third legs 139 are drawn or pulled upward so that the body section 136 bulges forwardly (FIG. 53). When the handle 155 is released, the clutch wheels 156 and 157 engage, holding the lumbar slide 68 in a fixed forwardly bulged position. The bulged third legs 139 push the lateral side section of the back shell 66 forwardly, partially around a seated user, as indicated by arrows 139A in FIG. 3. By repeating the above but by rotating the handle 155 in an opposite direction, the straps 158 are relaxed, allowing the stiffness of the third leg 139 to cause the third leg 139 to move to its natural planar shape. This allows the lateral side section of the back shell 66 to flex toward a more planar condition.

Notably, the forward movement of body section 136 is influenced by making the straps 158 stiffer or more flexible. The straps 158 must be stiff enough to press the body section 136 forwardly as the straps 158 are unwound from the rods 149 and 151, and preferably are stiff enough to urge the leg 139 toward the planar condition. The stiffness of the straps 158 and 159 influences the shape of the back shell 66 and the amount of lateral support so that it also gives support to a seated user's sides in the lumbar or lower back area. Specifically, the stiff straps 158 and 159 provide a leaf-spring-like section that extends from the rods 149 and 151 forwardly to bias the back shell 66 forwardly when the straps 158 and 159 are only partially wound around the rods 149 and 151.

The vertical height adjustment mechanism 74' (FIG. 21A) is operably mounted to the control housing 74 as follows. An inverted U-channel 179 is welded to housing 74 and includes a top horizontal wall 179'. A tapered tube section 183 is positioned in holes in the U-channel 179 and in housing 74 and is secured in place by flared flanges and/or by welding at its top and bottom ends. The top of the adjustable center post 73 is positioned in tube section 183, with a release button 180 for releasing the extendable gas spring in the center post 73 positioned in an accessible top/end location. A bridge 181 is positioned on U-channel 179 with its center section 182 extending generally over the release button 180. A side-to-side guide slot 182' is formed in center section 182, and a follower 184 is slidingly engaged with the slot 182'. The follower 184 includes a bottom curvilinear surface 185 forming a ramp that is constructed to operably engage and actuate the release button 180 as the follower 184 is moved toward one side. A spring 186 attached between the follower 184 and the bridge 181 biases the follower 184 to a normal position where the release button 180 is not depressed. A cable 187 is connected to follower 184 at attachment tab 188. A sleeve 189 telescopingly supports the cable 187, and the cable 187 is positioned through a side of the housing 74 to an actuator lever positioned either on a side of the housing 74 or in another convenient location. The cable assembly formed by cable 187 and sleeve 189 are commonly called Bowden cables.

A modified vertical height adjustment mechanism 74A' (FIGS. 21B and 21C) includes a bridge 181A attached to a bottom wall of housing 74 by a hooked end 190 and a bolted end 191. A lever 192 is pivoted to the bridge 181A at first end 193 and includes a second end 194 that abuttingly engages the release button 180. A roller 195 is operably rollingly positioned under the bridge 181A and on the lever 192. A spring 186A biases the roller 195 in a first direction, and a cable 187A is connected to the roller 195 for pulling the roller 195 in a second direction for operating the lever 192. The center post 73 and cable sleeve 189 are connected to the housing 74 in a manner similar to the adjustment mechanism 74'. Due to the downwardly concave shape of bridge 181A and the upwardly concave shape of the lever 192, the roller 195 biases the lever 192 into the release button 180 to depress the release button 180 as the roller 195 is pulled by the cable 187A, but the release button 180 is released as the cable is released and the spring 186A pulls the roller 195 back to a normal rest position.

The chair 50 offers several advantages over the known art. The extension 56 provides a back tilt axis that is located rearward of a rear edge of the seat, thus providing a different back movement during back recline that has a significantly different feel and, to many consumers, an improved feel. The extension allows existing synchrotilt controls to be used with only a limited number of additional major parts. Further, the extension is angularly adjustable on the existing control, thus allowing the angle of the back and seat to be changed when in the upright position. The armrest assembly is pivoted to a spine assembly that moves at a rate of rotation that is between the angular rate of rotation of the back and seat, such that the armrest assembly 61 also moves at an intermediate rate of rotation. Thus, the present back, armrest, and seat move at synchronous rates of rotation that are about 2:1.5:1 at the start of recline. The ratio of these synchronous rates of rotation will vary depending upon the extension and other members in the mechanisms and links that provide the synchronous motion. Nonetheless, the angular and intermediate rate of rotation of the armrest is advantageous, since the armrests are better positioned for the seated user regardless of whether the back is in a partial or full recline position. Also, it is noted that the armrests are vertically adjustable while seated in the chair by simply grasping the release lever under one of the armrests, thus making adjustment relatively easy.

The chair 50 also has a back construction that provides significant advantages. The back shell is very flexible, so that it provides a postural support that is very comfortable. A vertically adjustable lumbar slide supports the back shell in a lumbar area of a seated user. The lumbar slide is vertically adjustable to provide different amounts of lumbar support, depending upon a seated user's preference. Advantageously, the lumbar slide physically changes the shape of the lumbar area on the back shell, so that the lumbar support is immediate and active, rather than only reactive to pressure from a seated user's lumbar. A lower edge of the back shell is anchored by a tensioner, that pulls the back shell against the lumbar slide. This allows the lumbar slide to control the shape of the lumbar area of the back shell, even though the lumbar slide only engages a rear surface of the back shell. A novel lateral lumbar side support is provided that adjustably wraps partially around a seated user for comfortable side support. The lumbar side support is adjustable via a single rotatable actuator, transversely positioned on the lumbar slide.

A chair 50B (FIGS. 55–59) is similar to the chair 50, but includes modifications to its back, and its armrest and armrest supporting structure. In chair 50B, components and features that are similar or identical to the components and features of chair 50 are identified with the same numbers but with the addition of the letter "B". This is done for convenience and to reduce redundant discussion and to unnecessary paperwork, and should note be construed to be for other non-essential reasons.

The chair 50B (FIG. 55) includes a base 51B, a control 52B, a seat 53B, a back tilt bracket 54B (FIG. 57), a back construction 55B, an extension 56B, a back support 57B, and a backrest frame 58B. The back support 57B includes a modified spine assembly 60B (sometimes called a "back frame" herein) and a modified armrest assembly 61B, described as follows.

Figure 62:
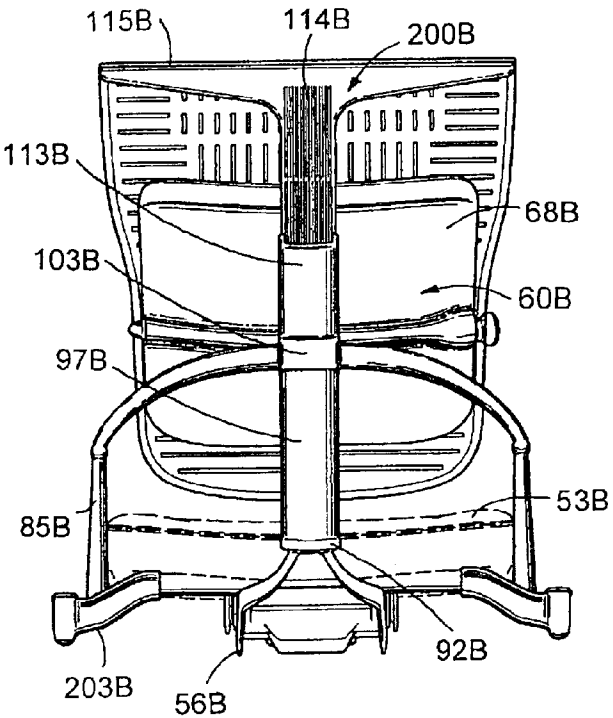
FIGS. 60–62 are side, top and rear views of the back and back supporting structure shown in FIG. 55.
Figure 61:
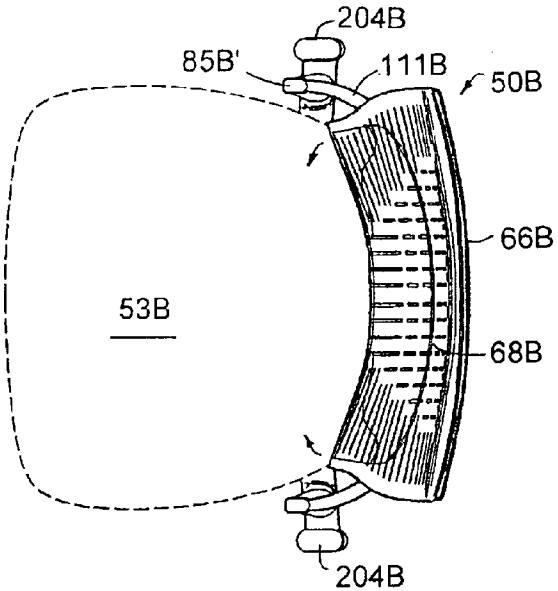
Figure 60:
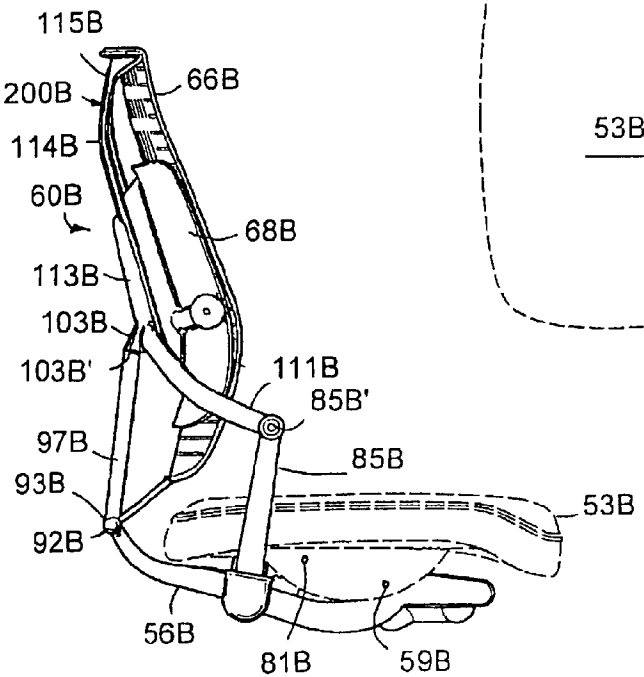

The modified spine assembly 60B (FIGS. 60 and 62) includes a T-shaped member 200B securely and non-adjustably fixed to a knuckle 113B. The T-shaped member 200B includes a top bracket 115B, and a vertical section 114B. The top bracket 115B ergonomically supports a top of the back shell 66B, for twisting movement of a seated user and the lumbar slide 68B is located between the knuckle 113B and the back shell 66B. The lumbar slide 68B slidably engages the vertical section 114B for ergonomic support of a seated user. Two tubular frame members 111B extend outwardly downwardly and forwardly from knuckle 113B, and each includes an end that is pivotally attached to the associated side supports 85B at the pivot axis 85B'. The knuckle 113B is pivoted to a top of the vertical frame member 97B of spine assembly 60B at top pivot 103B. The bottom of the vertical frame member 97B is pivoted at bottom pivot 92B to a rear of the extension 56B.

It is noted that the back tilt axis 59B, the seat tilt axis 81B, the secondary tilt axis 93B, the top pivot axis 103B', and the side pivot axis 85B' of chair 50B are in the same relative locations as the axes 59, 81, 93, 103' and 85A of chair 50.

The back construction 55B is basically the same as the back construction 55, except that back construction 55B does not include a cushion on its front surface. It is contemplated that a permanent or removable cushion can be applied to the seat and back. It is contemplated that clear or translucent material (such as a polyolefin or polycarbonate or hybrid blended for durability, flexibility, and transparency) will be used to make the back shell 66B. This provides a novel appearance, and also provides a functional result in that the lumbar slide 86 can be seen from a position in front of the chair, thus making it easier to see where the lumbar slide 86 is located or if an adjustment is required before getting in the chair.

Figure 63:
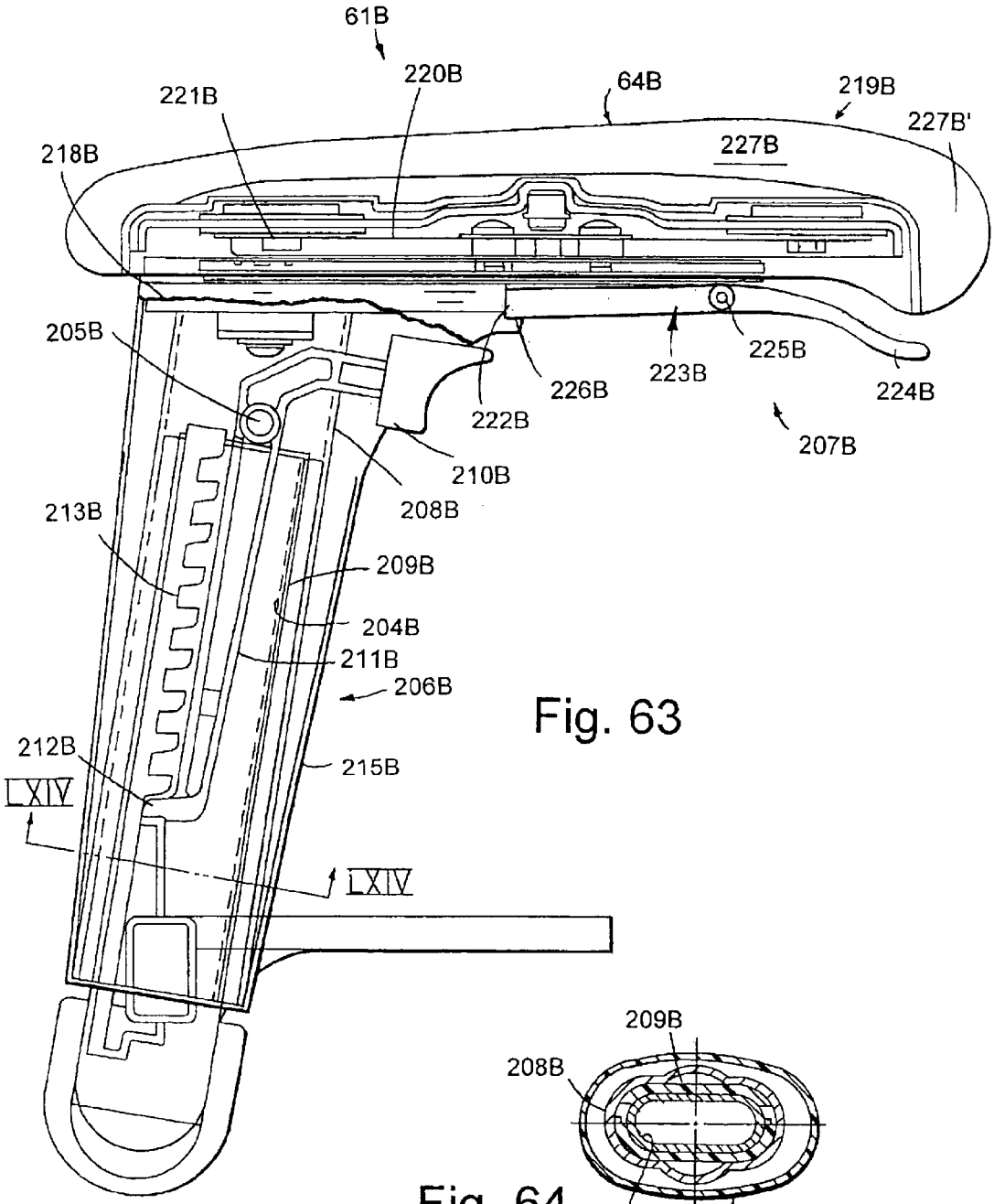
FIG. 63 is a side cross sectional view of the armrest shown in FIG. 55.

The modified armrest assembly 61B (FIG. 63) is supported on an armrest support structure comprising an L-shaped strut 202B (FIG. 56) with a horizontal leg 203B and a vertical leg 204B. It is contemplated that the horizontal leg 203B can be an extension of the horizontal portion of side supports 85B. In such case, the strut 202B moves with the seat 53B during recline. Alternatively, the strut 202B can be fixed to the housing 74B, such that the armrests assembly 61B is stationary and does not move upon recline.

Figure 64:
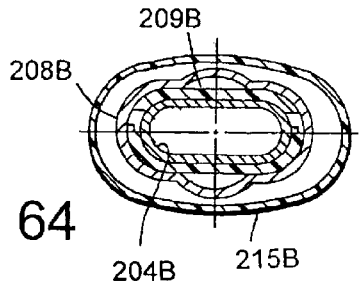
FIG. 64 is a cross sectional view taken along the line LXIV—LXIV in FIG. 63.
Figure 65:
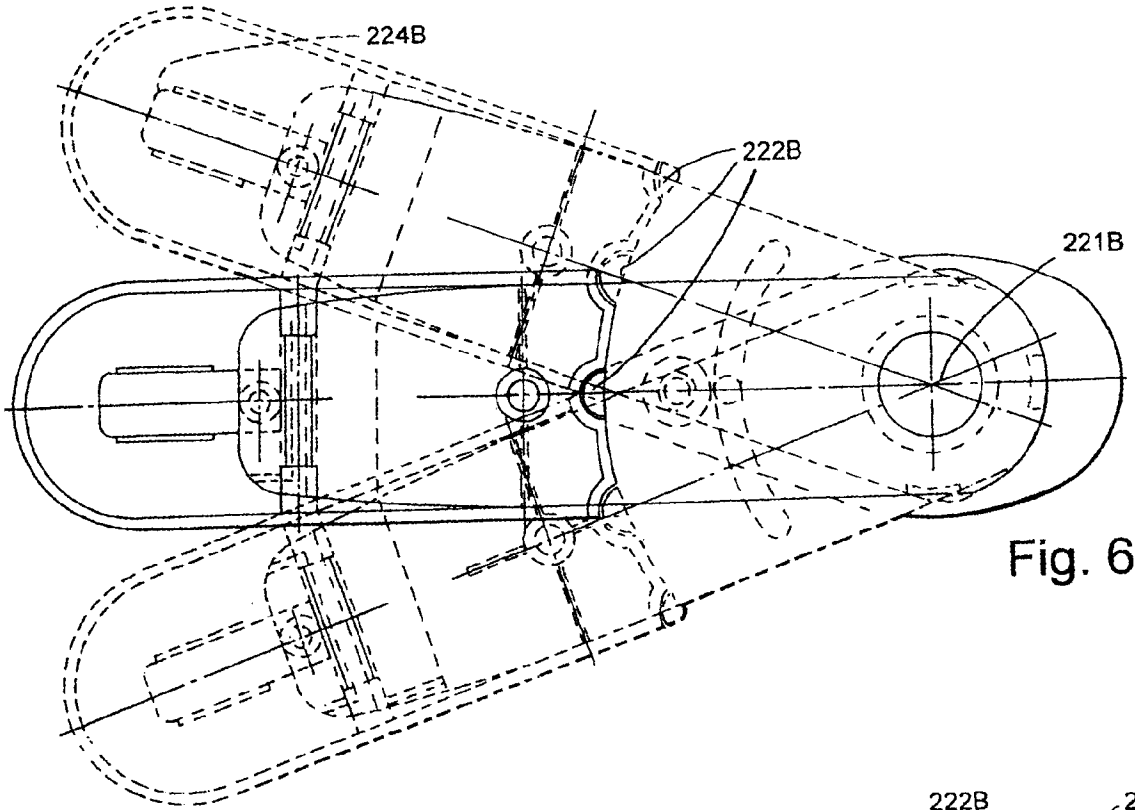
FIGS. 65 and 66 are top and side views of the armrest shown in FIG. 55.
Figure 68:
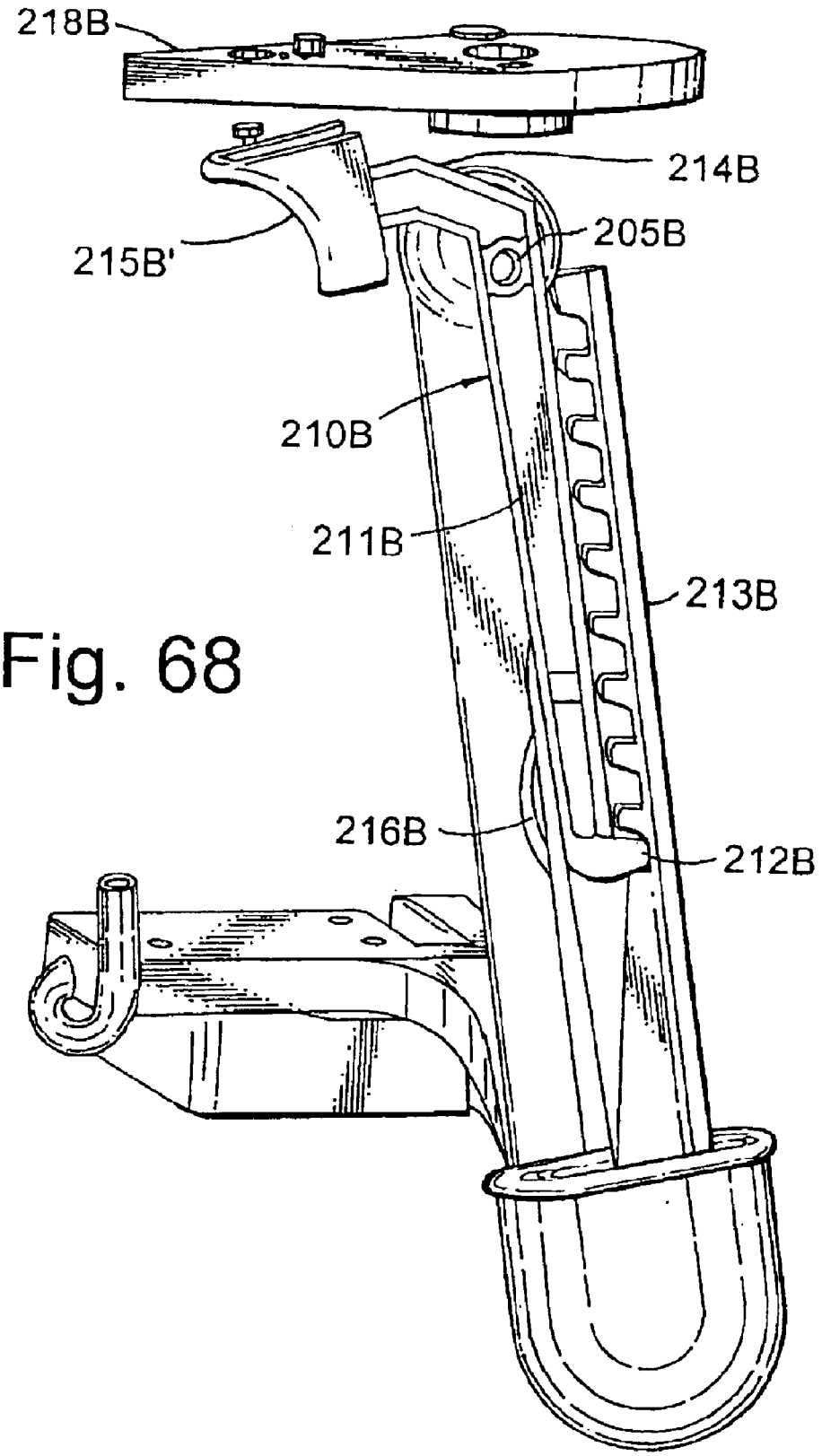
FIG. 68 is a side view of the internal components of the present armrest shown in FIG. 55, the tubular shroud and the inner bearing tube being removed to expose the latching mechanism for height adjustment.

The vertical leg 204B (sometimes called the "inner tube" herein) is structural and obround with flat sides and rounded ends (FIG. 64). The illustrated armrest 64B (FIG. 63) is T-shaped (or sometimes it is referred to as an inverted L-shape), and includes a vertical portion 206B that slidably engages the vertical leg 204B, and further includes a horizontal portion 207B. The vertical portion 206B includes an outer tube 208B (FIG. 64) and an intermediate plastic sleeve 209B that telescopingly and adjustably engage the vertical leg 204B. A shroud 215B surrounds the vertical leg 214B to provide a clean aesthetic appearance to the support structure. An L-shaped latch 210B (FIG. 63) is pivoted to the vertical portion 206B at pivot 205B. A vertical leg 211B of the latch 210B is located within the inner tube 204B, and includes a tooth 212B (FIG. 68) that releasably engages a multi-notched catch 213B that is fixed within the inner tube 204B. A horizontal leg 214B of the L-shaped latch 210B extends forwardly, and extends through an aperture in the outer shroud 215B to form a finger-shaped handle 215B' under a top part of the armrest in front of the vertical leg 204B. A leaf spring 216B biases the latch 210B so that the tooth 212B naturally engages a selected notch in the catch 213B. By pressing on the handle portion of the horizontal leg 214B, the latch 210B is pivoted in a forward direction to disengage the tooth 212B.

Figure 66:
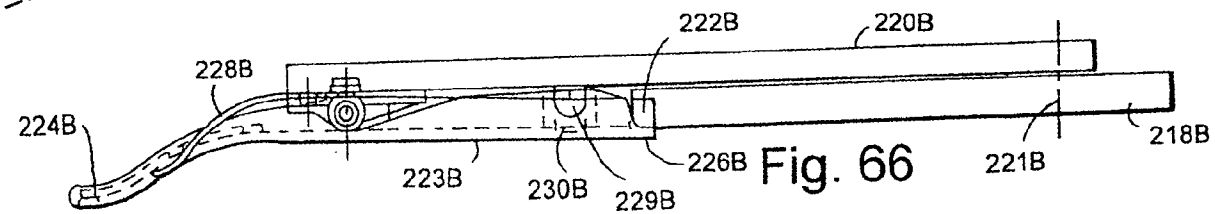
Figure 67:
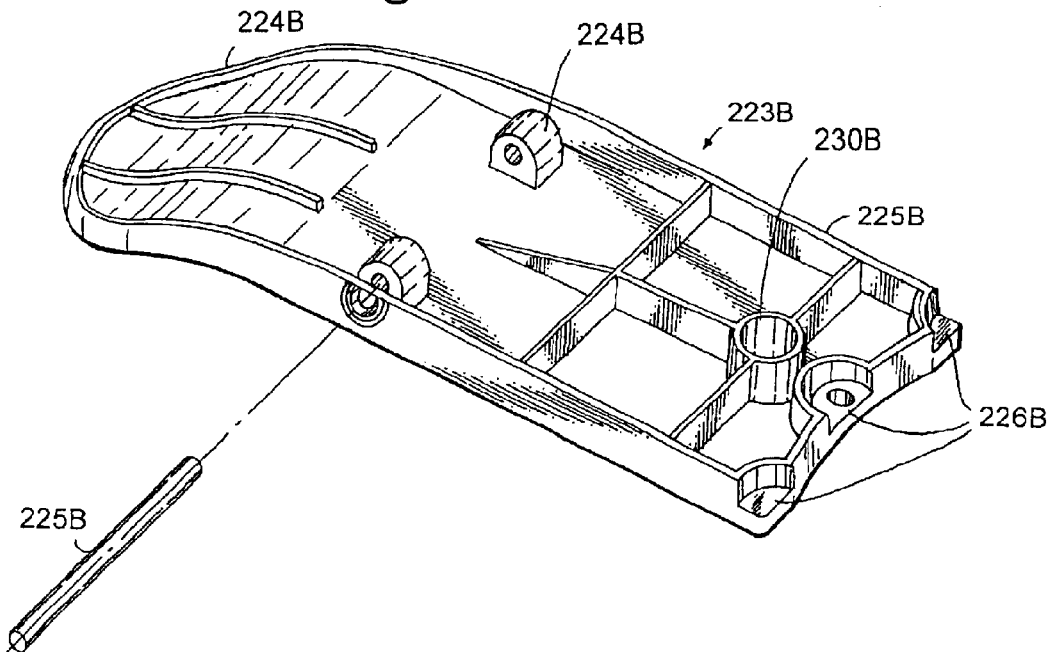
FIG. 67 is a perspective view of the latch member shown in FIG. 65.

The horizontal portion 207B of the armrest 64B (FIG. 63) includes a mounting block or plate 218B securely fixed atop the vertical tube 208B. A top armrest subassembly 219B includes a cushion-supporting plate 220B pivoted to the mounting block 218B at main pivot 221B. A front of the mounting block 218B includes one or more protrusions 222B. A latch lever 223B is pivoted to the plate 220B at a latch pivot (FIG. 66) by a pivot pin 225B. The latch lever 223B includes a front section 224B forming a handle under a front of the armrest 64B, and further includes a rear section 225B having recesses 226B shaped to selectively engage the protrusion(s) 222B. A foam cushion 227B (FIG. 63) is supported on the plate 220B and extends onto a front of 227B' of the armrest 64B, with the handle-forming front section 224B positioned just below it in an easily accessible location. A spring 228B biases the latch lever 223B to a position where the interlock recesses 226B engages one of the protrusion(s) 222B. An alignment pin 229B on plate 220B extends into a hole 230B in the latch lever 223B to help maintain alignment of the latch lever 223B on the plate 220B.

The armrest 64B can be vertically adjusted by depressing the handle-forming portion of horizontal member 214B of latch 210B, moving the armrest vertically to a newly selected position, and then releasing the handle-forming portion. The armrest 64B can be angularly adjusted by depressing the handle-forming portion of latch lever 223B, angularly adjusting the armrest subassembly 227B/220B, and releasing the latch lever 223B.

While the preferred embodiment has been described in some detail, those skilled in the art will recognize that various alternatives may be used that embody the invention described by the following claims. Accordingly, these claims are not intended to be interpreted as being unnecessarily limiting.

What is claimed is:

1. A chair comprising:

a base, a chair control mounted on the base;

a seat supported on the chair control;

a back upright pivotally attached to the chair control for movement between upright and reclined positions;

a flexible polymeric sheet made from a solid sheet of non-textile material attached at upper and lower connections to the back upright; and a vertically adjustable lumbar mechanism attached to the back upright and configured to bend the flexible sheet forwardly between the upper and lower connections to support a seated users lumbar region.

2. The chair of claim 1, wherein the lower connection is resilient.

3. The chair of claim 1, wherein the upper connection is located near a top edge of the sheet.

4. The chair of claim 3, wherein the upper connection extends along the top edge of the sheet.

5. The chair of claim 1, wherein the upper connection is located at a top of the back upright.

6. The chair of claim 1, wherein the lower connection is located at a bottom edge of the sheet.

7. The chair of claim 1, wherein the sheet includes perforations.

8. The chair of claim 7, wherein the perforations include slots.

9. The chair of claim 1, wherein the sheet includes a support surface adapted to ergonomically contact and support a seated user.

10. The chair of claim 1, wherein the back upright and the seat are both operably supported on the chair control and base for synchronous movement during recline of the back upright.

11. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright; and a vertically adjustable lumbar mechanism attached to the back upright and configured to bend the flexible sheet forwardly between the upper and lower connections to support a seated user's lumbar region, wherein the lower connection is resilient and includes a tensioner.

12. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright; and a vertically adjustable lumbar mechanism attached to the back upright and configured to bend the flexible sheet forwardly between the upper and lower connections to support a seated user's lumbar region, wherein the vertically adjustable lumbar mechanism is also horizontally adjustable.

13. The chair of claim 12, wherein the horizontal adjustment of the lumbar mechanism is non-uniform across the sheet.

14. The chair of claim 13, wherein the lumbar mechanism includes adjustable side members operably engaging side areas of die flexible sheet and characteristically not engaging a center area of the flexible sheet.

15. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright; and a vertically adjustable lumbar mechanism attached to the back upright and configured to bend the flexible sheet forwardly between the upper and lower connections to support a seated user's lumbar region, wherein the sheet includes perforations, and wherein the perforations include slots; wherein the sheet includes slots that are oriented and arranged to provide non-uniform flexibility across the sheet.

16. A chair comprising:

a base, a chair control mounted on the base;

a seat supported on the chair control;

a back upright pivotally attached to the chair control for movement between upright and reclined positions;

a flexible polymeric sheet made from a solid sheet of non-textile material attached at upper and lower connections to the back upright; and a vertically adjustable lumbar mechanism attached to the back upright and configured to bend the flexible sheet forwardly between the upper and lower connections to support a seated user's lumbar region wherein the sheet Is one of translucent or transparent.

17. A seating unit comprising:

a base;

a back upright pivotally supported on the base for movement between an upright position and a reclined position;

a flexible sheet made from a solid sheet of non-textile material operably supported on the back upright and adapted to ergonomically support a seated user; and a vertically adjustable lumbar mechanism operably movably attached to the back upright and configured to bend the flexible sheet and change a shape of the flexible sheet forwardly to ergonomically adjustably support a lumbar region of the seated user.

18. The seating unit of claim 17, wherein the sheet includes a support surface adapted to ergonomically contact and support a seated user.

19. The seating unit of claim 17, wherein the back upright and the seat are both operably supported on the chair control and base for synchronous movement during recline of the back upright.

20. A seating unit comprising:

base;

a back upright pivotally supported on the base for movement between an upright position and a reclined position;

a flexible sheet operably supported on the back upright and adapted to ergonomically support a seated user; and a vertically adjustable lumbar mechanism operably movably attached to the back upright and configured to bend the flexible sheet and change a shape of the flexible sheet forwardly to ergonomically adjustably support a lumbar region of the seated user; and an upper connection pivotally connecting the flexible sheet to the back upright.

21. The seating unit of claim 20, including a lower connection operably connecting the flexible sheet to the back upright.

22. The seating unit of claim 21, wherein the lower connection is resilient.

23. The seating unit of claim 22, wherein the lower connection includes a tensioner.

24. The seating unit of claim 20, wherein the horizontal adjustment of the lumbar mechanism is non-uniform across the sheet and includes adjustable side members operably engaging side areas of the flexible sheet.

25. A seating unit comprising:

a base;

a back upright pivotally supported on the base for movement between an upright position and a reclined position;

a flexible sheet operably supported on the back upright and adapted to ergonomically support a seated user; and a vertically adjustable lumbar mechanism operably movably attached to the back upright and configured to bend the flexible sheet and change a shape of the flexible sheet forwardly to ergonomically adjustably support a lumbar region of the seated user, wherein the vertically adjustable lumbar mechanism is also horizontally adjustable.

26. A chair comprising:

a base, a chair control mounted on the base;

a seat supported on the chair control;

a back upright pivotally attached to the chair control for movement between upright and reclined positions;

a flexible polymeric sheet made from a solid sheet of non-textile material attached at upper and lower connections to the back upright, the lower connection being near a bottom of the sheet;

the sheet including perforations, at least some of which are slots, allowing airflow, the sheet including a support surface adapted to ergonomically engage and support a seated user; and a vertically adjustable lumbar mechanism attached to the back upright and configured to bend the flexible sheet forwardly between the upper and lower connections to support a seated user's lumbar region.

27. The chair of claim 26, including a seat operably supported on the base for synchronous movement during recline of the back upright.

28. The chair of claim 26, the lower connection is resilient.

29. The chair of claim 26, wherein the upper connection is located at a top of the back upright.

30. The chair of claim 26, wherein the lower connection is located at a bottom edge of the sheet.

31. The chair of claim 26, wherein the upper connection is located near a top edge of the sheet.

32. The chair of claim 31, wherein the upper connection extends along the top edge of the sheet.

33. The chair of claim 26, wherein the upper connection is located at a top of the back upright.

34. The chair of claim 26, wherein the back upright includes a vertically-elongated spine component extending along a symmetrical vertical centerline of the sheet.

35. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright, the lower connection being near a bottom of the sheet:

the sheet including perforations, at least some of which are slots, allowing airflow, the sheet including a support surface adapted to ergonomically engage and support a seated user; and a vertically adjustable lumbar mechanism attached to the back upright and configured to bend the flexible sheet forwardly between the upper and lower connections to support a seated user's lumbar region, wherein the slots are oriented to cause a region of flexibility in the sheet.

36. The chair of claim 35, wherein the slots extend horizontally, and are located in a lumbar region on the sheet.

37. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright, the lower connection being near a bottom of the sheet;

the sheet including perforations, at least some of which are slots, allowing airflow, the sheet including a support surface adapted to ergonomically engage and support a seated user; and a vertically adjustable lumbar mechanism attached to the back upright and configured to bend the flexible sheet forwardly between the upper and lower connections to support a seated user's lumbar region, wherein at least a portion of the sheet is translucent.

38. A chair comprising:

a base, a chair control mounted on the base;

a seat supported on the chair control;

a back upright pivotally attached to the chair control for movement between upright and reclined positions;

a flexible polymeric sheet attached at upper and lower connections to the back upright, the lower connection being near a bottom of the sheet;

the sheet including perforations, at least some of which are slots, allowing airflow, the sheet including a support surface adapted to ergonomically engage and support a seated user; and a vertically adjustable lumbar mechanism attached to the back upright and configured to bend the flexible sheet forwardly between the upper and lower connections to support a seated user's lumbar region, wherein the adjustable lumbar mechanism is also horizontally adjustable.

39. The chair of claim 38, wherein the horizontal adjustment of the lumbar mechanism is non-uniform across the sheet.

40. The chair of claim 39, wherein the lumbar mechanism includes adjustable side members operably engaging side areas of the flexible sheet and characteristically not engaging a center area of the flexible sheet.

41. A chair comprising:

a base, a chair control mounted on the base;

a seat supported on the chair control;

a back upright pivotally attached to the chair control for movement between upright and reclined positions; the seat being operably supported to move synchronously during recline of the back upright;

a flexible polymeric sheet made from a solid sheet of non-textile material attached at upper and lower connections to the back upright, the lower connection being near a bottom of the sheet; the sheet including perforations allowing airflow and including a support surface adapted to ergonomically engage and support a seated user; and an adjustable lumbar mechanism attached to the back upright and configured to bend the flexible sheet forwardly between the upper and lower connections to support a seated user's lumbar region.

42. The chair of claim 41, wherein the adjustable lumbar mechanism is also horizontally adjustable.

43. The chair of claim 42, wherein the horizontal adjustment of the lumbar mechanism is non-uniform across the sheet.

44. The chair of claim 43, wherein the lumbar mechanism includes adjustable side members operably engaging side areas of the flexible sheet and characteristically not engaging a center area of the flexible sheet.

45. The chair of claim 41, wherein the upper connection is located near a top edge of the sheet.

46. The chair of claim 45, wherein the upper connection extends along the top edge of the sheet.

47. The chair of claim 41, wherein the upper connection is located at a top of the back upright.

48. The chair of claim 41, wherein the back upright includes a vertically-elongated spine component extending along a symmetrical vertical centerline of the sheet.

49. A chair comprising:

a base, a chair control mounted on the base;

a seat supported on the chair control;

a back upright pivotally attached to the chair control for movement between upright and reclined positions; the seat being operably supported to move synchronously during recline of the back upright;

a flexible polymeric sheet attached at upper and lower connections to the back upright, the lower connection being near a bottom of the sheet; the sheet including perforations allowing airflow and including a support surface adapted to ergonomically engage and support a seated user; and an adjustable lumbar mechanism attached to the back upright and configured to bend the flexible sheet forwardly between the upper and lower connections to support a seated user's lumbar region, wherein the sheet is translucent.

50. A chair comprising:

a base, a chair control mounted on the base;

a seat supported on the chair control;

a back upright pivotally attached to the chair control for movement between upright and reclined positions, the back upright including a vertically-elongated centrally-located spine component extending along a symmetrical vertical centerline of the chair control;

a flexible polymeric sheet attached at upper and lower connections to the back upright; and a vertically adjustable lumbar mechanism attached to the back upright and configured to bend the flexible sheet forwardly between the upper and lower connections to support a seated user's lumbar region.

51. The chair of claim 50, including a top bracket extending laterally from the spine component and supporting top corners of the polymeric sheet.

52. The chair of claim 50, wherein the sheet is made from a sheet of solid plastic material.

53. The chair of claim 50, wherein the sheet is translucent.

* * * * *